US008439136B2

(12) United States Patent
Jones et al.

(10) Patent No.: US 8,439,136 B2
(45) Date of Patent: May 14, 2013

(54) DRILL BIT FOR EARTH BORING

(75) Inventors: Mark L. Jones, Draper, UT (US); Kenneth M. Curry, South Jordan, UT (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 396 days.

(21) Appl. No.: 12/753,690

(22) Filed: Apr. 2, 2010

(65) Prior Publication Data

US 2010/0252332 A1 Oct. 7, 2010

Related U.S. Application Data

(60) Provisional application No. 61/166,183, filed on Apr. 2, 2009.

(51) Int. Cl.
*E21B 10/43* (2006.01)

(52) U.S. Cl.
USPC ..... 175/431; 76/108.4

(58) Field of Classification Search ..... 175/327, 175/398, 399, 412, 413, 425, 426, 428, 429, 175/431, 432, 434, 435; 76/108.1–108.4
See application file for complete search history.

(56) References Cited

U.S. PATENT DOCUMENTS

| | | | | |
|---|---|---|---|---|
| 1,873,814 | A | 8/1932 | Brewster | |
| 2,815,932 | A | 12/1957 | Wolfram | |
| 3,696,875 | A * | 10/1972 | Cortes | 175/430 |
| 4,352,400 | A | 10/1982 | Grappendorf et al. | |
| 4,440,247 | A | 4/1984 | Sartor | |
| 4,604,106 | A | 8/1986 | Hall et al. | |
| 4,714,120 | A * | 12/1987 | King | 175/431 |
| 4,815,342 | A | 3/1989 | Brett et al. | |
| 4,858,706 | A | 8/1989 | Lebourgh | |
| 4,907,662 | A | 3/1990 | Deane et al. | |
| 4,991,670 | A | 2/1991 | Fuller et al. | |
| 5,099,929 | A | 3/1992 | Keith et al. | |
| 5,131,478 | A | 7/1992 | Brett et al. | |
| 5,176,212 | A | 1/1993 | Tandberg | |
| 5,238,075 | A | 8/1993 | Keith et al. | |
| 5,244,039 | A * | 9/1993 | Newton et al. | 175/431 |

(Continued)

FOREIGN PATENT DOCUMENTS

GB 1357640 6/1974

OTHER PUBLICATIONS

International Preliminary Report on Patentability for International Application No. PCT/US2010/029840, dated Oct. 4, 2011, 4 pages.

(Continued)

*Primary Examiner* — William P Neuder
*Assistant Examiner* — Blake Michener
(74) *Attorney, Agent, or Firm* — Brinks Hofer Gilson & Lione

(57) ABSTRACT

Embodiments of the present invention include a drill bit comprised of a plurality of blades. A first plurality of the blades has cutting elements positioned substantially within the cone section of the drill bit. A second plurality of blades has cutting elements positioned substantially within the blade flank section and the blade shoulder section. Another embodiment of the first plurality of blades in which the blades end or truncate at a radial distance substantially less than the radial distance of the blade shoulder section from the center of the drill bit.

6 Claims, 16 Drawing Sheets

U.S. PATENT DOCUMENTS

| | | | | |
|---|---|---|---|---|
| 5,361,859 | A | 11/1994 | Tibbitts | |
| 5,363,932 | A | 11/1994 | Azar | |
| 5,366,031 | A | 11/1994 | Rickards | |
| 5,427,191 | A | 6/1995 | Rickards | |
| 5,607,025 | A | 3/1997 | Mensa-Wilmot et al. | |
| 5,735,360 | A | 4/1998 | Engstrom | |
| 5,957,223 | A | 9/1999 | Doster et al. | |
| 5,992,548 | A | 11/1999 | Silva et al. | |
| 6,065,553 | A * | 5/2000 | Taylor | 175/429 |
| 6,109,368 | A | 8/2000 | Goldman et al. | |
| 6,164,395 | A * | 12/2000 | Fuller et al. | 175/431 |
| 6,246,974 | B1 | 6/2001 | Jelley et al. | |
| 6,269,893 | B1 * | 8/2001 | Beaton et al. | 175/391 |
| 6,296,069 | B1 | 10/2001 | Lamine | |
| 6,302,223 | B1 | 10/2001 | Sinor | |
| 6,340,064 | B2 * | 1/2002 | Fielder et al. | 175/385 |
| 6,394,200 | B1 * | 5/2002 | Watson et al. | 175/385 |
| 6,695,073 | B2 | 2/2004 | Glass et al. | |
| 6,834,733 | B1 * | 12/2004 | Maouche et al. | 175/378 |
| 7,693,695 | B2 | 4/2010 | Huang et al. | |
| 7,694,756 | B2 | 4/2010 | Hall et al. | |
| 7,882,907 | B2 | 2/2011 | Engstrom | |
| 8,100,202 | B2 * | 1/2012 | Durairajan et al. | 175/426 |
| 2002/0020565 | A1 * | 2/2002 | Hart et al. | 175/385 |
| 2002/0074168 | A1 * | 6/2002 | Matthias et al. | 175/374 |
| 2004/0188149 | A1 * | 9/2004 | Thigpen et al. | 175/398 |
| 2006/0260845 | A1 * | 11/2006 | Johnson | 175/331 |
| 2007/0144789 | A1 * | 6/2007 | Johnson et al. | 175/431 |
| 2007/0261890 | A1 | 11/2007 | Cisneros | |
| 2008/0302575 | A1 * | 12/2008 | Durairajan et al. | 175/327 |
| 2009/0065263 | A1 * | 3/2009 | Shen et al. | 175/393 |
| 2009/0145669 | A1 * | 6/2009 | Durairajan et al. | 175/431 |
| 2009/0266619 | A1 * | 10/2009 | Durairajan et al. | 175/431 |
| 2010/0018780 | A1 * | 1/2010 | Johnson et al. | 175/426 |
| 2011/0100724 | A1 * | 5/2011 | Azar | 175/428 |

OTHER PUBLICATIONS

P.D. Spanos et al., Oil Well Drilling: A Vibrations Perspective, The Shock and Vibration Digest, Mar. 2003, pp. 81-99, vol. 35, No. 2, Sage Publications, US.

Thomas M. Warren et al., Development of a Whirl-Resistant Bit, SPE Drilling Engineering, Dec. 1990, pp. 267-274, US.

* cited by examiner

DRILL BIT FOR EARTH BORING

PRIORITY CLAIM

This application claims the benefit of and priority from U.S. Provisional Patent Application No. 61/166,183 filed on Apr. 2, 2009 that is incorporated in its entirety for all purposes by this reference.

FIELD

The present application relates to drill bits used for earth boring, such as water wells; oil and gas wells; injection wells; geothermal wells; monitoring wells, mining; and, other operations in which a well-bore is drilled into the Earth.

BACKGROUND

Specialized drill bits are used to drill well-bores, boreholes, or wells in the earth for a variety of purposes, including water wells; oil and gas wells; injection wells; geothermal wells; monitoring wells, mining; and, other similar operations. These drill bits come in two common types, roller cone drill bits and fixed cutter drill bits.

Wells and other holes in the earth are drilled by attaching or connecting a drill bit to some means of turning the drill bit. In some instances, such as in some mining applications, the drill bit is attached directly to a shaft that is turned by a motor, engine, drive, or other means of providing torque to rotate the drill bit.

In other applications, such as oil and gas drilling, the well may be several thousand feet or more in total depth. In these circumstances, the drill bit is connected to the surface of the earth by what is referred to as a drill string and a motor or drive that rotates the drill bit. The drill string typically comprises several elements that may include a special down-hole motor configured to provide additional or, if a surfaces motor or drive is not provided, the only means of turning the drill bit. Special logging and directional tools to measure various physical characteristics of the geological formation being drilled and to measure the location of the drill bit and drill string may be employed. Additional drill collars, heavy, thick-walled pipe, typically provide weight that is used to push the drill bit into the formation. Finally, drill pipe connects these elements, the drill bit, down-hole motor, logging tools, and drill collars, to the surface where a motor or drive mechanism turns the entire drill string and, consequently, the drill bit, to engage the drill bit with the geological formation to drill the well-bore deeper.

As a well is drilled, fluid, typically a water or oil based fluid referred to as drilling mud is pumped down the drill string through the drill pipe and any other elements present and through the drill bit. Other types of drilling fluids are sometimes used, including air, nitrogen, foams, mists, and other combinations of gases, but for purposes of this application drilling fluid and/or drilling mud refers to any type of drilling fluid, including gases. In other words, drill bits typically have a fluid channel within the drill bit to allow the drilling mud to pass through the bit and out one or more jets, ports, or nozzles. The purpose of the drilling fluid is to cool and lubricate the drill bit, stabilize the well-bore from collapsing or allowing fluids present in the geological formation from entering the well-bore, and to carry fragments or cuttings removed by the drill bit up the annulus and out of the well-bore. While the drilling fluid typically is pumped through the inner annulus of the drill string and out of the drill bit, drilling fluid can be reverse-circulated. That is, the drilling fluid can be pumped down the annulus (the space between the exterior of the drill pipe and the wall of the well-bore) of the well-bore, across the face of the drill bit, and into the inner fluid channels of the drill bit through the jets or nozzles and up into the drill string.

Roller cone drill bits were the most common type of bit used historically and featured two or more rotating cones with cutting elements, or teeth, on each cone. Roller cone drill bits typically have a relatively short period of use as the cutting elements and support bearings for the roller cones typically wear out and fail after only 50 hours of drilling use.

Because of the relatively short life of roller cone bits, fixed cutter drill bits that employ very durable polycrystalline diamond compact (PDC) cutters, tungsten carbide cutters, natural or synthetic diamond, other hard materials, or combinations thereof, have been developed. These bits are referred to as fixed cutter bits because they employ cutting elements positioned on one or more fixed blades in selected locations or randomly distributed. Unlike roller cone bits that have cutting elements on a cone that rotates, in addition to the rotation imparted by a motor or drive, fixed cutter bits do not rotate independently of the rotation imparted by the motor or drive mechanism. Through varying improvements, the durability of fixed cutter bits has improved sufficiently to make them cost effective in terms of time saved during the drilling process when compared to the higher, up-front cost to manufacture the fixed cutter bits.

Unfortunately, fixed cutter bits have several disadvantages. The first is that fixed cutter bits often have problems with stability while drilling. Specifically, fixed cutter bits often undergo what is referred to as whirl and/or dynamic instability, which often is characterized by shocks, or chaotic movement within the well-bore that takes the form of suddenly stopping, i.e., rotation momentarily ceases at the drill bit or at just a portion of the drill bit but not within the drill string; sudden release of the energy stored within the drill string when the bit begins to rotate again; uncontrolled and rapid movement laterally against the wall of the well-bore; and bouncing, or rapid movement in the longitudinal direction parallel to the long axis of the well-bore. The severity of these movements can exceed 100 times the force of gravity and damage the drill bit, the drill string, surface equipment, and other items. In addition, the excess energy released in these various shocks is not used to drill the well-bore, resulting in slower rates of drilling, or rate-of-penetration (ROP), and possibly damaging the cutters and/or the drill bit, leading to increased drilling costs.

Various methods have been attempted to reduce the occurrence of whirl and/or dynamic instability, but none have been wholly satisfactory. Computer modeling to balance the anticipated forces on the drill bit provides some improvement, but cannot account for the variety of factors encountered during the drilling process. Using more, smaller diameter cutting elements and more blades on the bit improves the stability of the bit because there exist more points of contact between the drill bit and the well-bore, but such a configuration typically costs more to manufacture and reduces the rate at which the fixed cutter bit drills the well-bore, thereby increasing the total cost. Conversely, using a fixed cutter bit with larger diameter cutting elements and fewer blades and/or fewer number of cutters typically improves the rate-of-penetration and lowers the cost to manufacture the bit, but stability is reduced.

In addition to resisting whirl and/or dynamic instability, the drill bit is part of a dynamic system with both known and unknown inputs. While the inputs into the system at the surface may be known, e.g., type of bit, force or weight applied to the bit at the surface, torque applied at the surface, the actual effect of these surface inputs is typically more variable and less predictable at the drill bit and is only occasionally known through the use of specialized measurement tools located near the drill bit that are capable of transmitting that information to the driller/user at the surface. Such specialized tools are rarely run because of the cost, thus the actual conditions and inputs to which the bit is exposed is typically unknown or known only in partial detail, thus requiring educated guess-work to modify the inputs to improve the operation of the drill bit.

Unfortunately, drill bits typically have a small range of operating conditions in which they operate effectively, such as remaining stable while rotating (which is more than just avoiding whirl) and efficiently drilling subsurface geological formations. Thus, there exists a need for a drill bit that operates efficiently and remains rotational stable over a wide range of conditions.

Thus, there exists a need for a cost-effective, stable fixed cutter drill bit that provides improved stability without sacrificing rate-of-penetration.

SUMMARY

Embodiments of the present invention include a drill bit that includes a connection that allows for the drill bit to be removably attached or connected to a means of providing a rotational force. The drill bit includes a body that includes a flank portion and a crown, or cone, portion and a plurality of blades positioned thereabout. The plurality of blades each have a plurality of cutting elements positioned and supported thereon, the plurality of cutting elements typically of the type referred to as polycrystalline diamond compacts, or PDCs, tungsten carbide, synthetic or natural diamond, and other hard materials. A first plurality of blades includes one or more cutting elements generally positioned in the crown portion of the blades but no cutting elements generally positioned in the flank portion. A second plurality of blades includes one or more cutting elements generally positioned in the flank portion of the blades but few to no cutting elements generally positioned in the crown portion.

Another embodiment of the invention includes a first plurality of blades with a blade portion generally positioned within the crown portion of the drill bit. The first plurality of blades also includes a gauge pad positioned within the flank portion of the drill bit. The first plurality of blades includes one or more cutting elements generally positioned in the crown portion of the blades but no cutting elements generally positioned in the flank portion. A second plurality of blades includes a blade portion generally positioned within the flank portion of the drill bit. The second plurality of blades includes a gauge pad positioned within the flank portion of the drill bit. The second plurality of blades does not include a blade portion positioned generally within the crown portion of the drill bit. The second plurality of blades includes one or more cutting elements generally positioned in the flank portion of the blades but few to no cutting elements generally positioned in the crown portion.

Another embodiment of the invention includes a first plurality of blades with a blade portion generally positioned within the crown portion of the drill bit. The first plurality of blades does not include a blade portion positioned generally positioned within the flank portion of the drill bit. The first plurality of blades includes one or more cutting elements generally positioned in the crown portion of the blades but no cutting elements generally positioned in the flank portion. A second plurality of blades includes a blade portion generally positioned within the flank portion of the drill bit. The second plurality of blades includes a gauge pad positioned within the flank portion of the drill bit. The second plurality of blades does not include a blade portion positioned generally within the crown portion of the drill bit. The second plurality of blades includes one or more cutting elements generally positioned in the flank portion of the blades but few to no cutting elements generally positioned in the crown portion.

Other configurations of the blades, blade portions, and cutting elements, are disclosed herein and fall within the scope of the disclosure. In addition, methods of manufacturing various embodiments of the drill bit are disclosed herein.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

Figure 1:
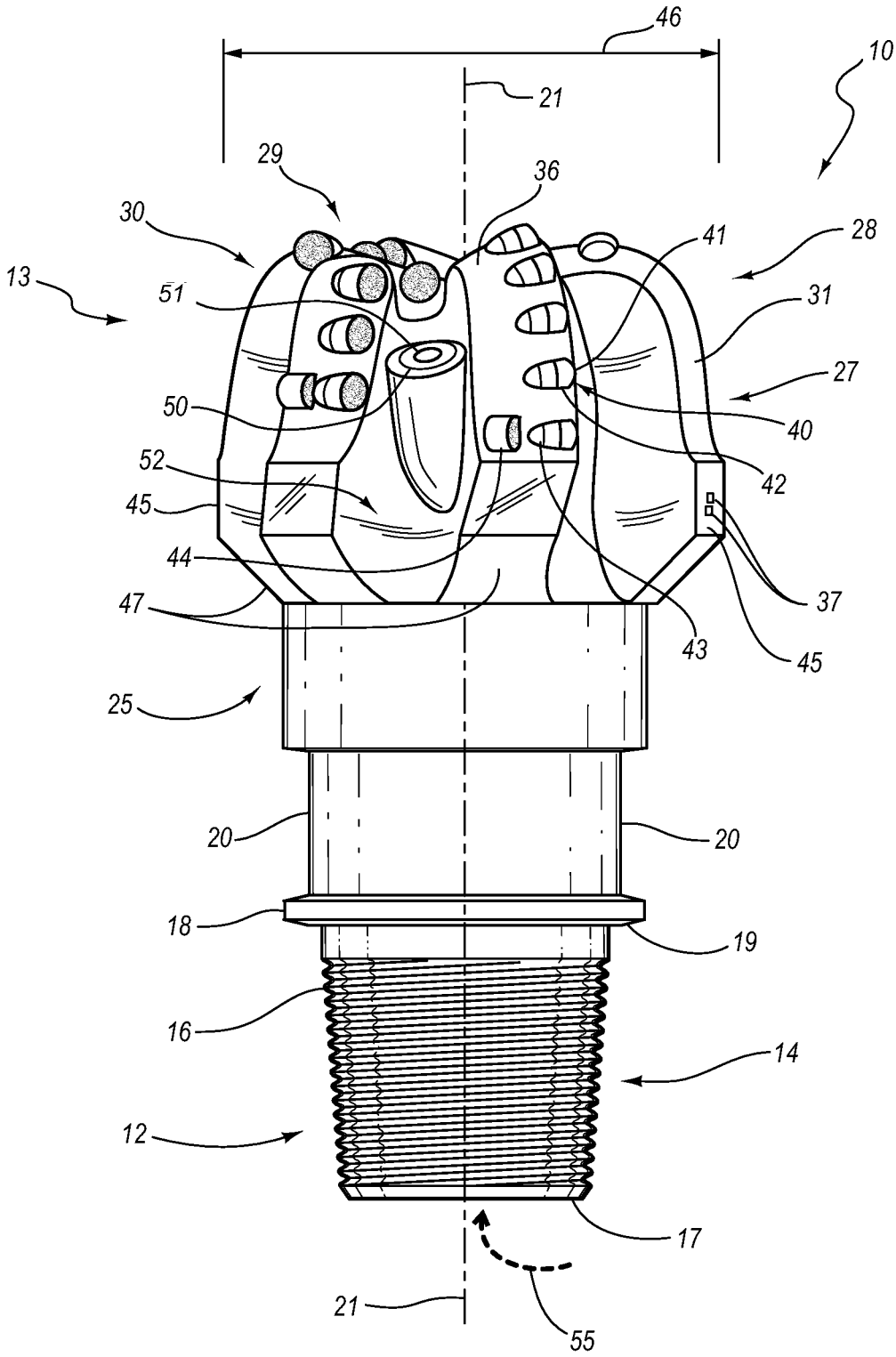
FIG. 1 is a side-view of an embodiment of a drill bit.

The drawings are not necessarily to scale.

DETAILED DESCRIPTION

FIGS. 1, 2, 6, 7, 10, and 11 illustrate various views and embodiments of a drill bit 10 configured to drill well-bores in the earth. The drill bit 10 is suitable for, but not limited to, drilling oil and gas wells onshore and offshore; geothermal wells; water wells; monitoring and/or sampling wells; injection wells; directional wells, including horizontal wells; bore holes in mining operations; bore holes for pipelines and telecommunications conduits; and other types of wells and boreholes.

The drill bit 10 includes a first end 12 that includes a shank or connection means 14 configured to couple or mate the drill bit 10 to a drill string or a drill shaft that is coupled to a means of providing rotary torque or force, such as a motor, downhole motor, drive at the surface, or other means, as described above in the background. The connection means 14 include a typical pin connection with threads 16 that have a chamfer 17 configured to reduce stress concentrations at the end of the threads 16 and to ease mating with the box connection in the drill string, a shank shoulder 18, and the sealing face 19 of the connection. Of course, the connection means can be a box connection described further below, bolts, welded connection, joints, and other means of connecting the drill bit 10 to a motor, drill string, drill, top drive, downhole turbine, or other means of providing a rotary torque or force. The threads typically are of a type described as an American Petroleum Institute (API) standard connection of various diameters as known in the art, although other standards and sizes fall within the scope of the disclosure. The threads 16 are configured to operably couple with the threads of a corresponding or analogue box connection in the drill string, collar, downhole motor, or other connection to the bit as known in the art. The sealing face 19 provides a mechanical seal between the drill bit 10 and the drill string and prevents any drilling fluid passing through the inner diameter of the drill string and the drill bit 10 from leaking out.

Figure 2:
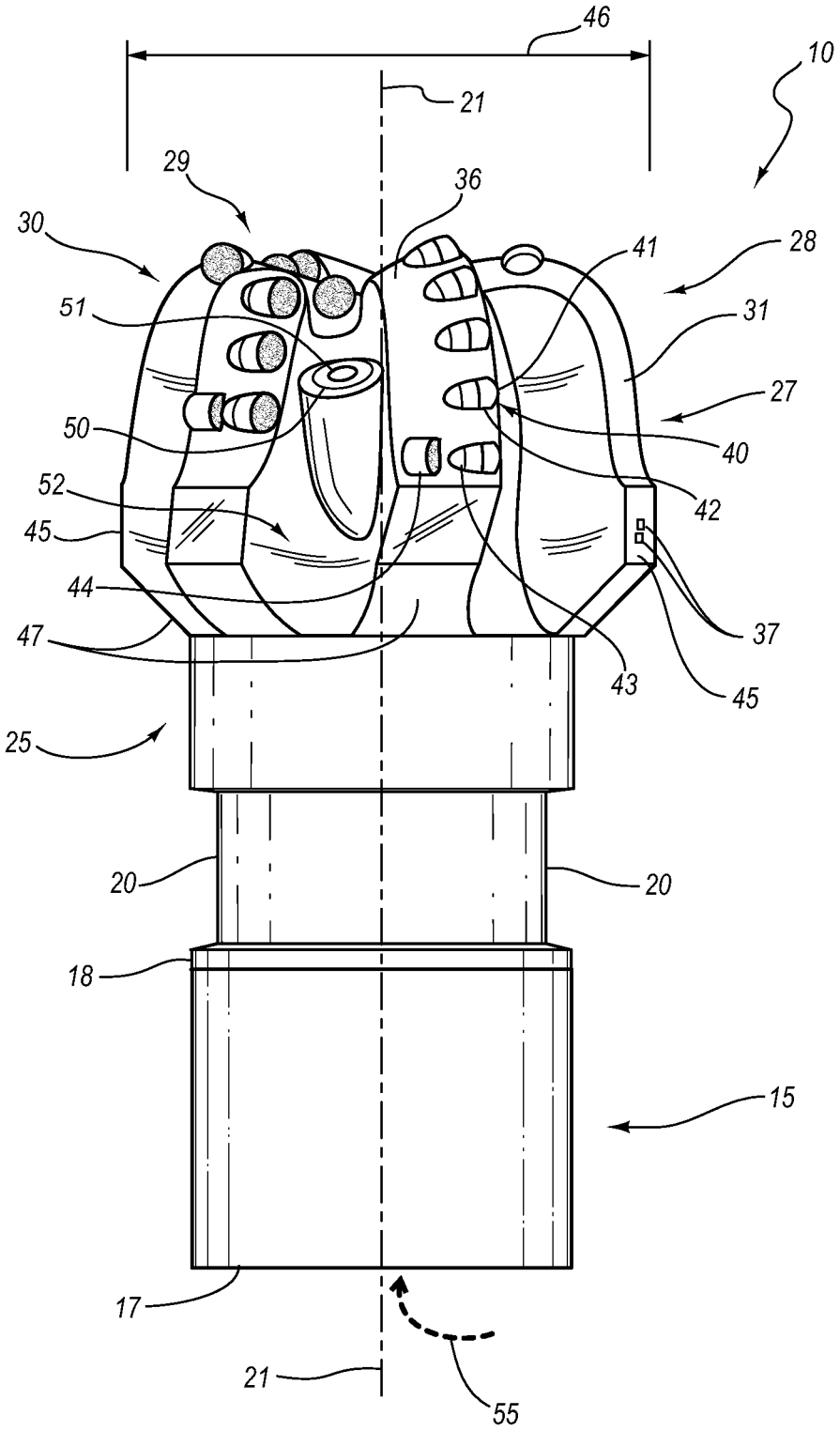
FIG. 2 is side-view of an alternative embodiment of the drill bit illustrated in FIG. 1.

FIG. 2 illustrates another embodiment of the drill bit 10 that uses a box connection 15 rather than the pin connection 14 illustrated in FIG. 1. The box connection 15 configuration is less common, although it still falls within the scope of the disclosure. The box connection 15 has internal threads (not shown) similar to the external threads 16 of the pin connection 14 illustrated in FIG. 1. The box connection 15 typically is of a type described as an American Petroleum Institute (API) standard connection of various diameters as known in the art, although other standards and sizes fall within the scope of the disclosure. The threads of the box connection 15 are configured to operably couple with the threads of a corresponding or analogue pin connection in the drill string, collar, downhole motor, or other connection to the bit as known in the art. The sealing face 19 provides a mechanical seal between the drill bit 10 and the drill string and prevents any drilling fluid passing through the inner diameter of the drill string and the drill bit 10 from leaking out.

The embodiments of the drill bit 10 include a breaker slot 20 configured to accept a bit breaker therein. The bit breaker is used to connect or mate the drill bit 10 to the drill string and provides a way to apply torque to the drill bit 10 (or to prevent the drill bit 10 from moving as torque is applied to the drill string) while the drill bit 10 and the drill string are being coupled together or taken apart.

The bit body 25 includes one or more drill bit blades 30 connected thereto that optionally extend past the bit body 25 in both a radial direction from the centerline 21 and a vertical direction towards and proximate to a second end 13 of the drill bit 10, as illustrated in FIG. 1, the bit body 25 being attached or fixedly coupled to the connection 14, 15. The bit body 25 can be formed integrally with the drill bit blades 30, such as being milled out of a single steel blank. Alternatively, the drill bit blades 30 can be welded to the bit body. Another embodiment of the bit body 25 and blades 30 is one formed of a matrix sintered in a mold of a desired shape under temperature and pressure, typically a tungsten carbide matrix with a nickel binder, with drill bit blades 30 also integrally formed of the matrix with the bit body 25. A steel blank in the general shape of the bit body 25 and the drill blades 30 can be used to form a scaffold and/or support structure for the matrix. The bit body 25 also can be formed integrally with the connection 14, 15 from a steel blank or a steel connection 14, 15 can be welded to the bit body 25.

The drill bit 10 includes one or more blades 30 that includes a cone section 29 within a first radius proximate the centerline 21 of the drill bit 10; a blade flank section 28 spaced laterally away at a greater radial distance from the centerline 21 than the cone section 29; a blade shoulder section 27 spaced further laterally away at a greater radial distance from the centerline 21 than the blade the flank section 28; and a gauge (or gage) pad 45 typically proximate the greatest radial distance, or one-half the bit diameter 46 of the drill bit 10, from the centerline 21 and proximate the bit body 25. In other embodiments, the gauge pad 45 is less than the greatest radial distance. The gauge pad 45 optionally includes a crown chamfer 47 adjacent to the bit body 25.

Figure 9:
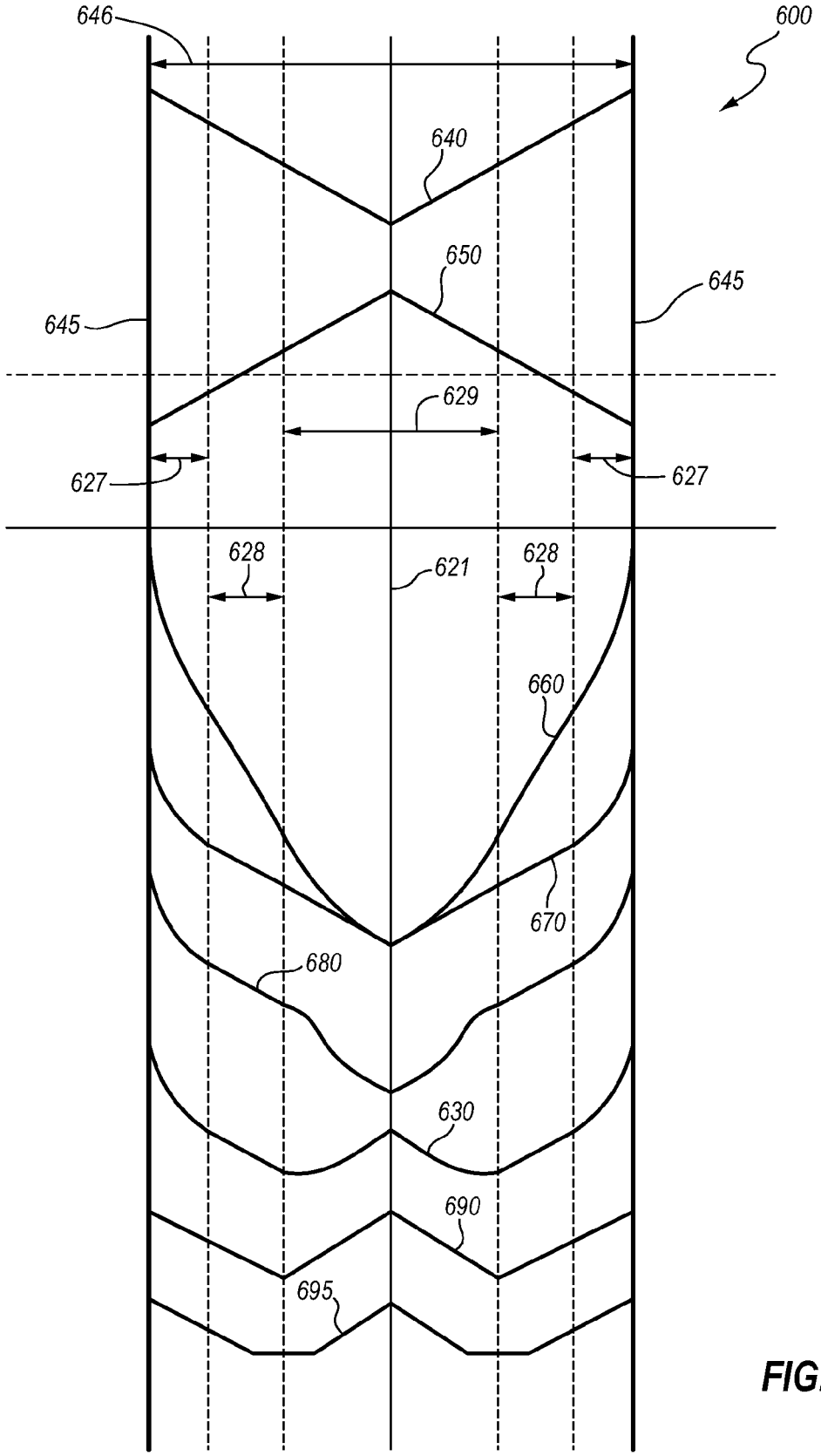
FIG. 9 is a side view of various embodiments of blade profiles of embodiments of drill bits that fall within the scope of this disclosure.

The relative positions of the cone section 29, blade flank section 28, blade shoulder section 27, and gauge pad section 45 with respect to the bit centerline are better illustrated in the diagram of various blade profiles 600 illustrated in FIG. 9. The centerline of an embodiment of the drill bit 10 is illustrated by the centerline 621 in FIG. 9 and the maximum diameter of the drill bit 10 is illustrated as the gauge diameter 646, which corresponds with the gauge diameter 46 illustrated in FIGS. 1 and 2.

Various profiles of embodiments of blades 30 are illustrated as lines 640; 650; 660; 670; 680; 690; and 695. The profiles 600 illustrate the aggregate profile of the blades 30. In other words, the blades 30, taken as a whole, would generally appear as the embodiment of the profiles 600 if all of the blades 30 were laid flat on a plane through the centerline 621.

Still referring to FIG. 9, the cone section 29 of drill bit 10 generally falls within the cone diameter 629. Of course, it will be understood that the cone section 629 may extend slightly more or less than the cone diameter 629 as illustrated because the cone diameter 629 is shown for illustrative and qualitative purposes. In other words, the cone section 629 encompasses that portion of the blades 30 relatively closest to the centerline 621 of the drill bit 10.

The blade flank section 28 of the drill bit 10 falls within the blade flank section 628 illustrated adjacent to and at a further radial distance from the centerline 621 than the cone section 629 in FIG. 9. Of course, it will be understood that the blade flank section 628 may extend slightly more or less than the blade flank section 628 as illustrated because the blade flank section 628 is shown for illustrative and qualitative purposes. In other words, the blade flank section 628 encompasses that portion of the blades 30 relatively further from the centerline 629 than the cone section 629 but not as far as the blade shoulder section 627.

The blade shoulder section 27 of the drill bit 10 falls within the blade shoulder section 627 illustrated adjacent to and at a further radial distance from the centerline 621 than the cone section 629 and the blade flank section 628 in FIG. 9. Of course, it will be understood that the blade shoulder section 627 may extend slightly more or less than the blade shoulder section 627 as illustrated because the blade shoulder section 627 is shown for illustrative and qualitative purposes. In other words, the blade shoulder section 627 encompasses that portion of the blades 30 relatively further from the centerline 621 than the cone section 629 and the blade flank section 628 but not as far as the blade gauge section 645.

Returning to FIGS. 1, 6, and 7, the drill bit 10 with blades 30 is illustrated to have 6 distinct blades 31, 32, 33, 34, 35, and 36 that are best illustrated in FIG. 7. Each of the blades 31 through 36 is slightly different for the reasons that will be discussed below, including the shape of each blade and the placement of the cutters 40 along the blade. The blades 30 can have a shape selected for various factors, including the formation drilled, the size of the hole desired, the capability of the equipment (drilling rig, drill string, etc.), cost, and other considerations.

Figure 7:
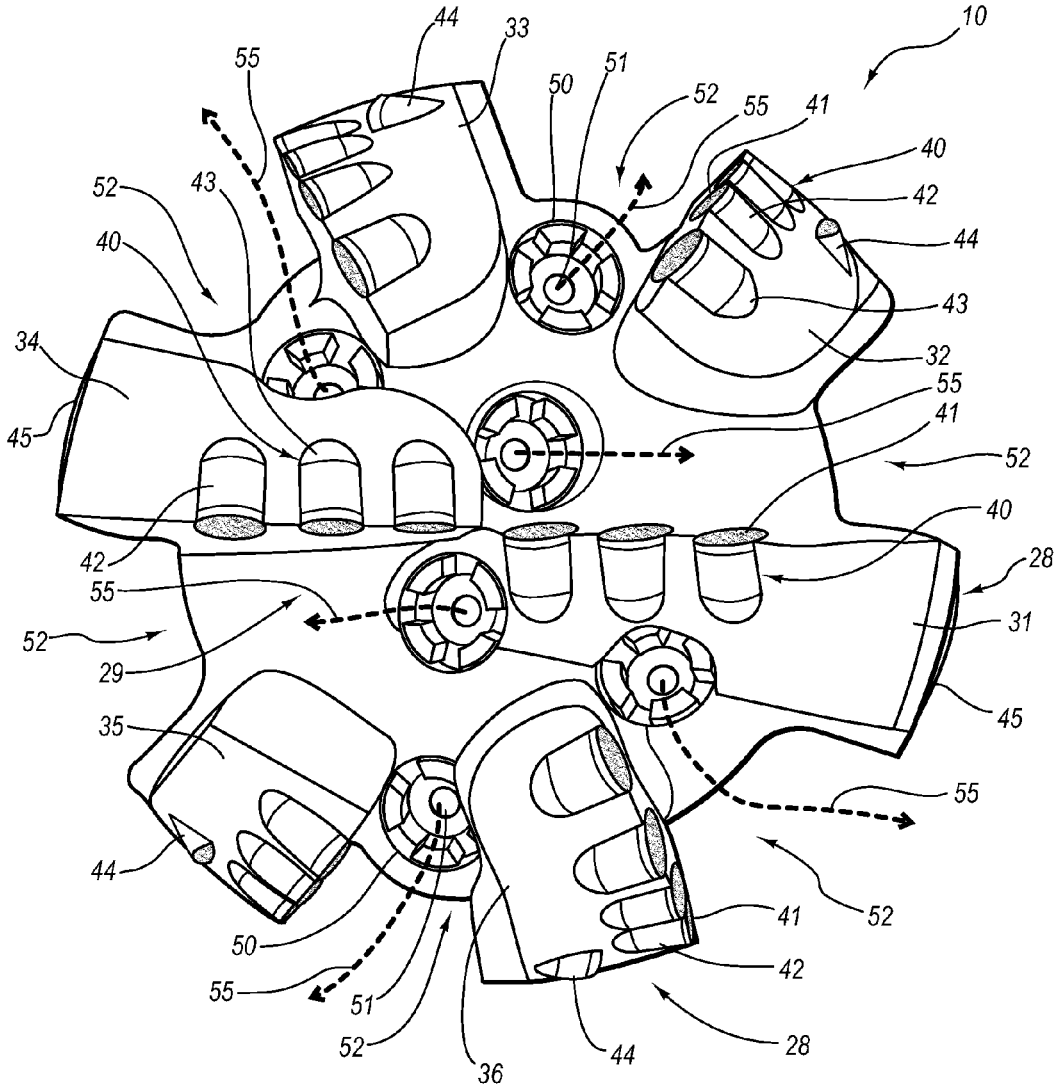
FIG. 7 is a top-view of the drill bit illustrated in FIG. 1.
Figure 8:
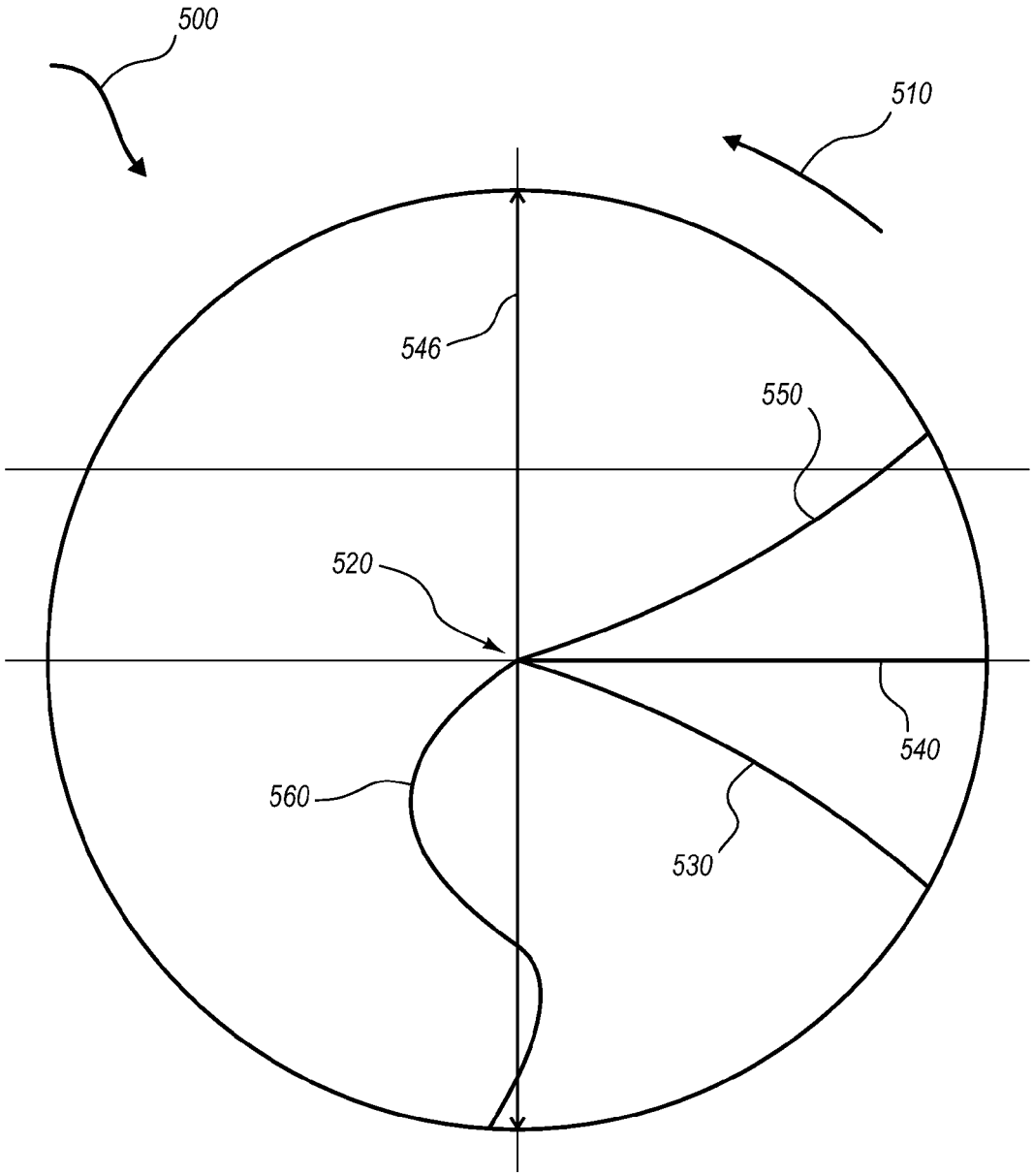
FIG. 8 is a top view of various embodiments of blade profiles of embodiments of drill bits that fall within the scope of this disclosure.

As an example, FIG. 8 illustrates several embodiments of blade shapes 500 with a gauge diameter 546 as if viewed by looking directly at the crown section 29 of the drilling bit 10. One embodiment of the blade shapes is blade shape 530 that has a trailing radius of curvature relative to the direction of rotation 510. The straight blade shape 540 is qualitatively the same as that of blades 30 illustrated in FIGS. 1, 2, 6, and 7 and has substantially no radius of curvature and is perpendicular to the direction of rotation 510 of the drill bit. Yet another embodiment includes a blade shape 550 that has a leading radius of curvature.

Of course, it will be understood that different blades in a given drill bit might have different blade shapes, lines, arcs, and or splines, either more or less aggressive, than any other given blade on the drill bit. Further, a blade shape need not remain constant, either straight or have a constant radius of curvature as its radial distance from the center of the bit increases. For example, blade shape 560 indicates a blade whose radius of curvature changes significantly as the radial distance from the center increases, from a trailing radius of curvature to a leading radius of curvature, something that might be suitable for drilling horizontal wells along very thin geological formations of different hardness.

Similarly and looking at FIG. 9 at the aggregate blade profiles 600 illustrate the varying profiles that fall within the scope of the disclosure. Blade profile 695 illustrates an embodiment of the aggregate blade profiles 31 through 36 of drill bit 10 that has a recessed, or negative, cone section 629, a relatively flatter blade flank section 628, and a negative blade shoulder section 627. Blade profile 690 is similar to that of blade profile 695, but with sharper transitions, whereas blade profile 630 has smoother transitions between the various sections. Other various profiles include 670, 660, 650, and 640. Of course, it will be understood that embodiments of the blade profiles 600 include others in between those illustrated as well as combinations of various sections, lines, arcs, and or splines, of those illustrated.

Turning back to FIGS. 1, 6, and 7, a particular embodiment of the drill bit 10 includes two blades 31 and 34 that have cutters 40 located substantially within the cone section 29 but not elsewhere, two blades 33 and 36 that have cutters located substantially in the blade flank section 28 and substantially in the blade shoulder section 27, and two blades 32 and 35 that have cutters located substantially in the flank section 28 and the shoulder section 27. Such a configuration with relatively larger diameter cutters 40 positioned in such a layout provides the higher rate-of-penetration as a four-bladed drill bit with the same size and number of cutters 40 positioned at the same radial distance from the centerline of the drill bit 10, but provides the greater stability of a six-bladed drill bit.

In other words, the novel configuration and placement of the cutters 40 around this configuration and number of blades 31-36 provides improved performance as compared to previous versions of four and six-bladed drill bits. Of course, drill bits with different numbers of blades and cutters in which one or more blades, or a first plurality of blades, with one or more cutters positioned substantially in the cone section of the drill bit, and a second plurality of blades with one or more cutters positioned substantially within the blade flank section and/or the blade shoulder section, fall within the scope of the embodiments disclosed herein.

The cutters 40 illustrated in the figures are of a polycrystalline diamond compact (PDC) type, but cutters of the other materials, such as tungsten carbide, natural or synthetic diamond, and other hard materials can be used. The embodiment of the cutters 40 include the PDC cutting element 41 configured with a side that interlocks with the substrate 42 and positioned in a pocket 43 of the blade 31, for example, as known in the art.

The cutters 40 are positioned on the various blades 30 at selected radial distances from the centerline 21 depending on various factors, including the desired rate-of-penetration, hardness and abrasiveness of the expected geological formation or formations to be drilled, and other factors. For example, two or more cutters 40 may be placed at the same radial distance from the centerline 21, typically on different blades 30, such as blade 32 and blade 34, and, therefore, would cut over the same path through the formation. Another embodiment includes positioning two or more cutters 40 at only slightly different radii from the centerline 21 of the drill bit 10, again, typically on different blades 30, so that the path that each cutter makes through a geological formation overlaps slightly with the cutter at the next further radial distance from the centerline of the drill bit 10.

In addition, the distance a given cutter 40 travels during a single revolution of the drill bit 10 increases as the radial distance of the cutter 40 from the centerline 21 of the drill bit 10 increases. Thus, a cutter 40 positioned at a greater radial distance from the centerline 21 of the drill bit 10 travels a greater distance for each revolution of the drill bit 10 than another cutter 40 positioned at a lesser radial distance from the centerline 21 of the drill bit 10. As such, the first cutter at the greater radial distance would wear faster than the second cutter at the lesser radial distance. In view of this, relatively more cutters 40 are positioned relatively more closely, i.e., with relatively less radial distance separating those cutters 40 at adjacent radial distances (even if on different blades) the greater the absolute radial distance from the centerline 21 of the drill bit 10 (such as those cutters in the blade shoulder section 28) as compared to those cutters 40 positioned at relatively shorter radial distance, i.e., closer to the centerline 21 of the drill bit 10, such as those cutters in the cone section 29. Further, as a radial distance of a given cutter 40 increases, other factors related to the cutter position are typically, although not necessarily, selected to be less aggressive, including the exposure, back-rake, and side-rake, as described below.

Figure 3:
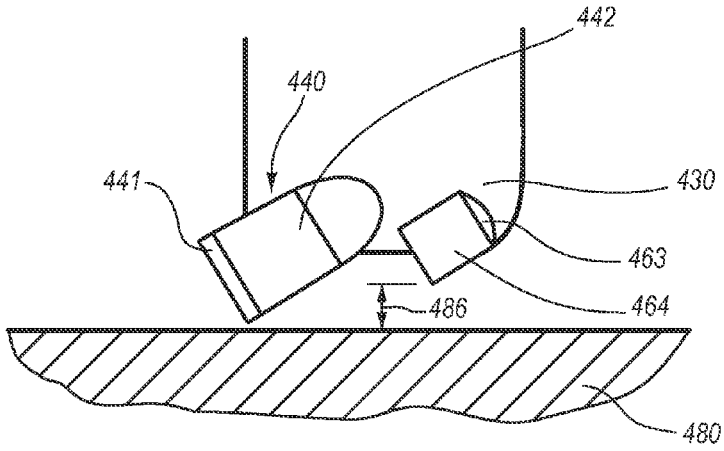
FIG. 3 is a close-view of an embodiment of a cutting element employed in embodiments of the invention.
Figure 4:
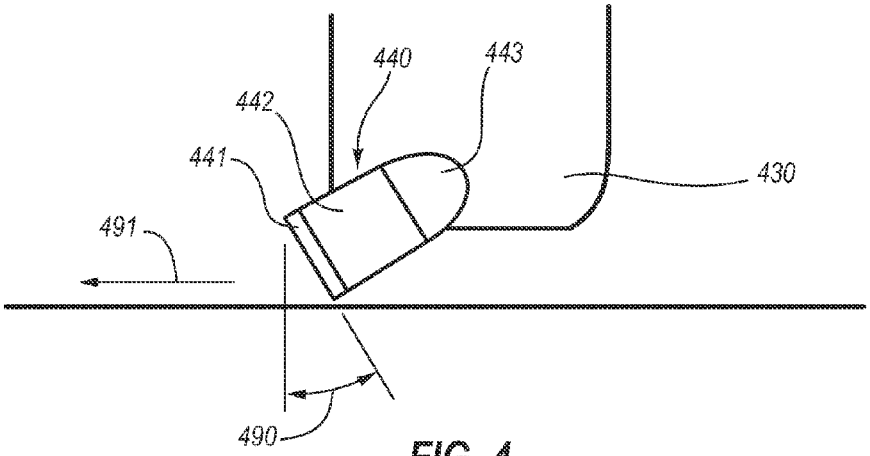
FIG. 4 is a close-view of another embodiment of cutting element employed in embodiments of the invention.
Figure 5:
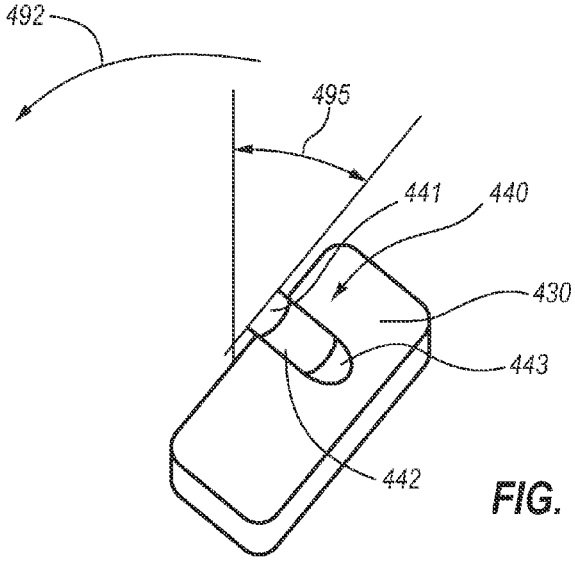
FIG. 5 is a close-view of another embodiment of a cutting element employed in embodiments of the invention.
Figure 6:
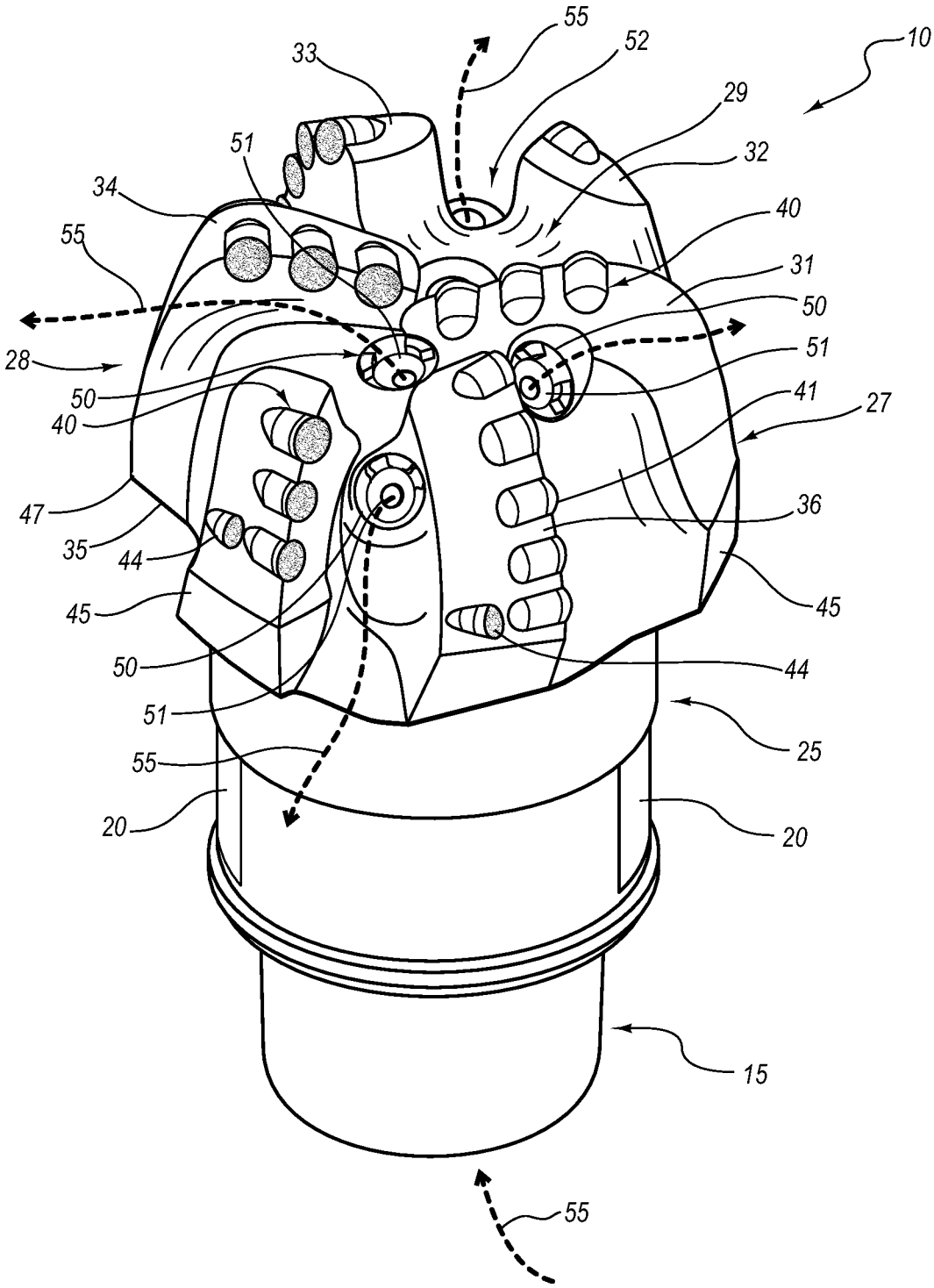
FIG. 6 is an isometric view of the drill bit illustrated in FIG. 1.

FIGS. 3, 4, and 5 illustrate various factors related to cutter placement that are considered in their placement in various embodiments illustrated herein. An embodiment of a cutter 440 illustrated in FIG. 3 cuts or drills the geological formation 480. The cutter 440 with a PDC cutting element 441 and substrate 442 is positioned in the pocket 443 of the blade 430. Of course, other types of cutters as discussed above fall within the scope of the disclosure. Also illustrated in FIG. 3 is an optional backup cutter 464 of a similar hard material as that in the cutter 440 (e.g., it can be one of the types of materials and others known in the art as discussed above, but it need not be the same material as the cutter 440) that can be positioned at approximately the same radial distance from the centerline of the drill bit as the cutter 440 and is typically positioned behind the cutter 440 relative to the direction of rotation of the drill bit on the same blade 430 as illustrated or on another blade of the drill bit. A given backup cutter 464 for a given cutter 440, however, may be positioned in front (relative to the direction of rotation of the drill bit) of the cutter 440 either on the same blade 430 or another blade of the drill bit. The backup cutter 464 illustrated is formed of tungsten carbide and is positioned in pocket 463 of the blade 430. The backup cutter 464 can alternatively be a PDC cutter, synthetic or natural diamond, or other hard cutting element.

The backup cutter 464 optionally is positioned a distance 486 from the geological formation 480 initially, i.e., before drilling begins. Typically, the backup cutter 464 only begins to engage the geological formation 480 when the cutter 440 wears sufficiently, closing the distance 486. When the backup cutter 464 engages the geological formation 480, it bears a portion of the torque and weight on bit (the force on the bit in a direction parallel to the well-bore) that would otherwise have been borne solely by the cutter 440, thereby reducing the wear on the cutter 440 and increasing the life of the cutter 440. While the distance 486 is illustrated as allowing some distance between the geological formation 480 and the backup cutter 464 when the cutter 440 is new (i.e., unworn), the backup cutter 464 can be positioned to engage the geological formation 480 concurrently with the cutter 440 is new, i.e., the distance 486 is effectively zero. In other embodiments, the backup cutter 464 can be designed to engage the geological formation 480 before the cutter 440 does so, i.e., the distance 486 is effectively negative. The distance 486 is selected in consideration of the characteristics of the geological formation to be drilled and other factors known in the art and may vary among different backup cutters at different radial distances from the center of the drill bit.

The cutter 440 illustrated in FIG. 4 is positioned in the pocket 443 of the blade 430 that travels in the direction 491. The angle 490 describes the back-rake of the cutting element 441 relative to the direction of travel 491. The back-rake angle 490 illustrated in FIG. 4 is a negative angle and is considered to be less aggressive and suitable for relatively harder geological formations. A back-rake angle of zero degrees corresponds to the cutting element 441 perpendicular to the direction of travel 491 and is more aggressive and suitable for relatively softer geological formations than a negative back-rake angle. A positive back-rake angle is even more aggressive than a back-rake angle of zero degrees and is suitable for respectively softer geological formations. Thus, the back-rake angle of a selected cutter is chosen in consideration of various factors, including its radial distance from the center of the drill bit, the type of material from which the cutters are formed, the characteristics of the geological formation to be drilled (abrasiveness, hardness, and others known in the art), and the like.

FIG. 5 illustrates the side-rake angle 495 of a cutting element 441 of a cutter 440 relative to the direction of rotation 492. The side-rake angle 495 illustrated in FIG. 4 is a negative angle. A side-rake angle of zero degrees corresponds to the cutting element 441 perpendicular to the direction of rotation 492. A positive side-rake angle is even more aggressive than a back-rake angle of zero degrees. Thus, the side-rake angle of a selected cutter is chosen in consideration of various factors, including its radial distance from the center of the drill bit, the type of material from which the cutters are formed, the characteristics of the geological formation to be drilled (abrasiveness, hardness, and others known in the art), and the like.

Returning to FIGS. 1, 2, 6 and 7, the drill bit 10 optionally includes a gauge pad 45 typically positioned a radial distance from the centerline 21 of one-half of the gauge diameter 46. In other embodiments, the gauge pad 70 is positioned at less than the radial distance, i.e., less than one-half the gauge diameter 46. The gauge pad 45 optionally includes gauge protection 37, which can be hard-facing and/or a selected pattern of tungsten carbide, polycrystalline diamond, or natural or synthetic diamond, or other hard materials to provide increased wear-resistance to the gauge pad 45 to increase the probability that the drill bit 10 substantially retains its gauge diameter 46. The gauge pad 45 also optionally includes a crown chamfer 47 that forms the transition between the gauge pad 45 and the bit body 25.

Drill bit 10 optionally includes one or more gauge cutters 44 positioned in the blade shoulder section 27 to provide backup to the cutters at the greatest radial distance from the centerline 21 of the drill bit 10, similar to the backup cutter 464 described above in FIG. 3. Optionally, the gauge cutter 44 can be positioned behind or below a selected cutter 40 or on a separate or different gauge pad 45. The gauge cutter 44 typically is of a smaller size and/or diameter than the cutters 40, but the gauge cutter 44 can also be the same size and or diameter or a larger size and/or diameter than the cutters 40. The gauge cutter 44 can be formed of tungsten carbide, PDC, synthetic or natural diamond, or other hard material.

Other features of the drill bit 10 include one or more nozzle bosses 50 that are an integral part of the bit body 25. The nozzle bosses 50 have a fixed area through which drilling fluid or drilling mud 55 flows after passing through an inner diameter of the drill string and through the inner diameter or annulus of the drill bit. Typically, the nozzle bosses 50 are configured to receive a jet, nozzle, or port 51 of various diameters or sizes and optionally includes threads or other means to secure the jets or nozzles 51 in position as known in the art. The jets, ports, or nozzles 51 are typically field replaceable to adjust the total flow area of the jets or nozzles 51 and have a selected diameter chosen to balance the expected rate-of-penetration and, consequently, the rate at which drill cuttings are created by the bit and removed by the drilling fluid, the necessary hydraulic horsepower, and capabilities of the drilling rig facilities, particularly the pressure rating of the drilling rig's fluid management system and the pumping capacity of its mud pumps, among other factors. In some instances, a blank jet nozzle 51 may be placed in a particular nozzle boss 50 preventing any fluid from flowing through that particular boss 50. Such a configuration is useful for jetting operations when initially drilling into the seafloor in a new offshore well. Conversely, no jet nozzle 51 can be used when desired.

Figure 18:
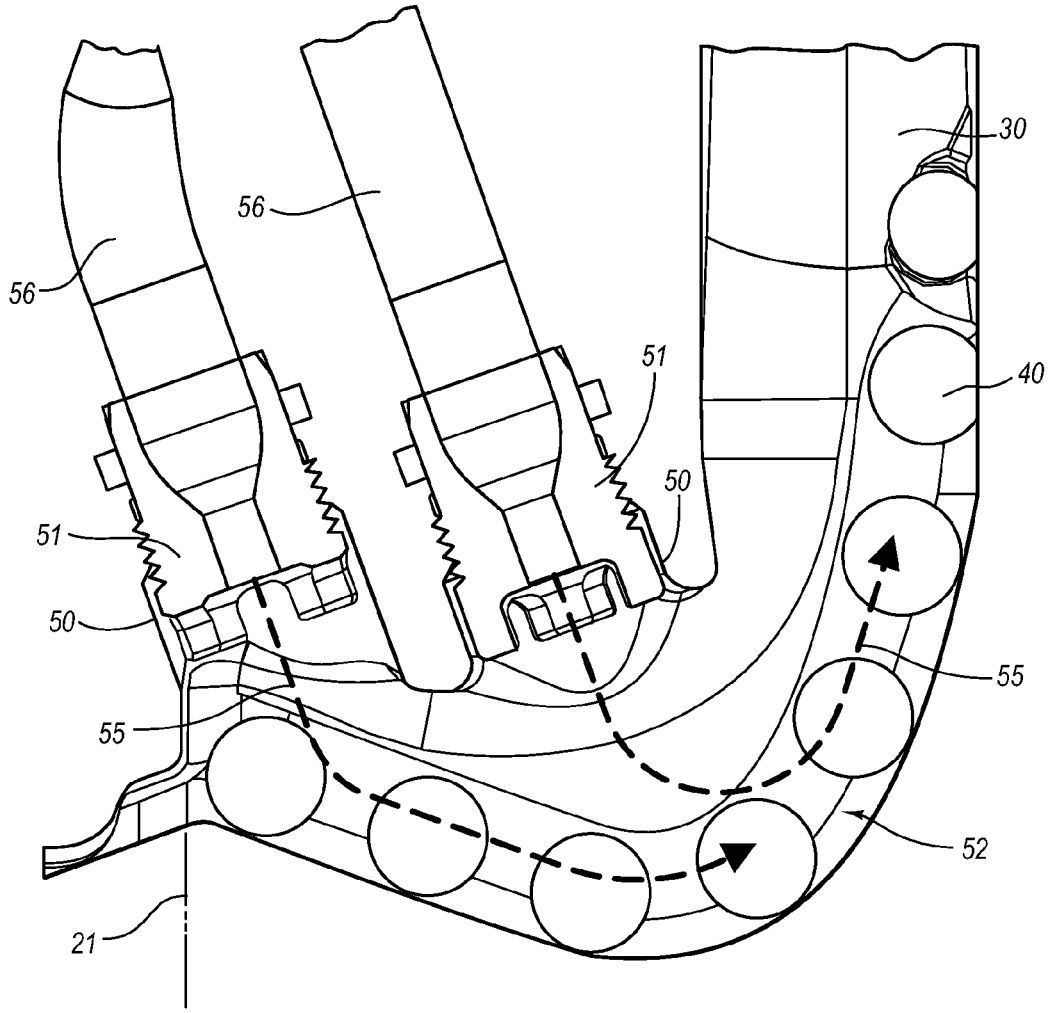

The flow path of the drilling fluid 55 is best illustrated in FIG. 7. As illustrated, the various nozzle bosses 50 and jets or nozzles 51 have an orientation selected to enhance the removal of drill cuttings from face of each blade 30 and from the cone section 29 of the bit and move them towards the annulus of the well-bore. Stated differently, the orientation of the nozzle boss 50 and jets or nozzles 51 is such that the drilling fluid 55 cleans the cutters 40 and the blades 31-36 of the drill bit 10. An idealized representation of the flow path of the drilling fluid 55 across the cutters 40 is illustrated in FIG. 18. The drilling fluid flows from the inner annulus of the drill bit 10 into the flow paths 56, into the nozzle bosses 50 and out the jets or nozzles 51, sweeping drilled formation cuttings out of the fluid channels/junk slots 52, away from the cutters 40, and up the annulus of the well-bore. Turning back to FIG. 7, while six nozzle bosses 50, one for each blade 31-36, exist, either more or fewer nozzle bosses 50, jets or nozzles 51 can be used as selected for a given situation.

The drilling fluid 55 flows through the fluid channels or junk slots 52, which are sized and positioned relative to the blades 31-36 based on the expected rate-of-penetration, characteristics of the geological formation, particularly hardness and whether the formation swells or expands in the presence of the drilling fluid used, average size of the formation cuttings created, and other factors known in the art. For example, smaller (i.e., narrower) fluid channels 52 result in a higher fluid velocity with the result that formation cuttings are carried away more easily and quickly from the drill bit 10. However, smaller fluid channels or junk slots 52 raise the risk that one or more of the fluid channels 52 could become blocked by the formation cuttings, resulting in premature or uneven wear of the bit, reduced rate-of-penetration, and other negative effects. Of course, as discussed above, the drilling fluid 55 can flow through the drill string and out the jets or nozzles 51 as is typical, or it can be reverse circulated down the annulus, into the jets or nozzles 51, and up the drill string.

Figure 10:
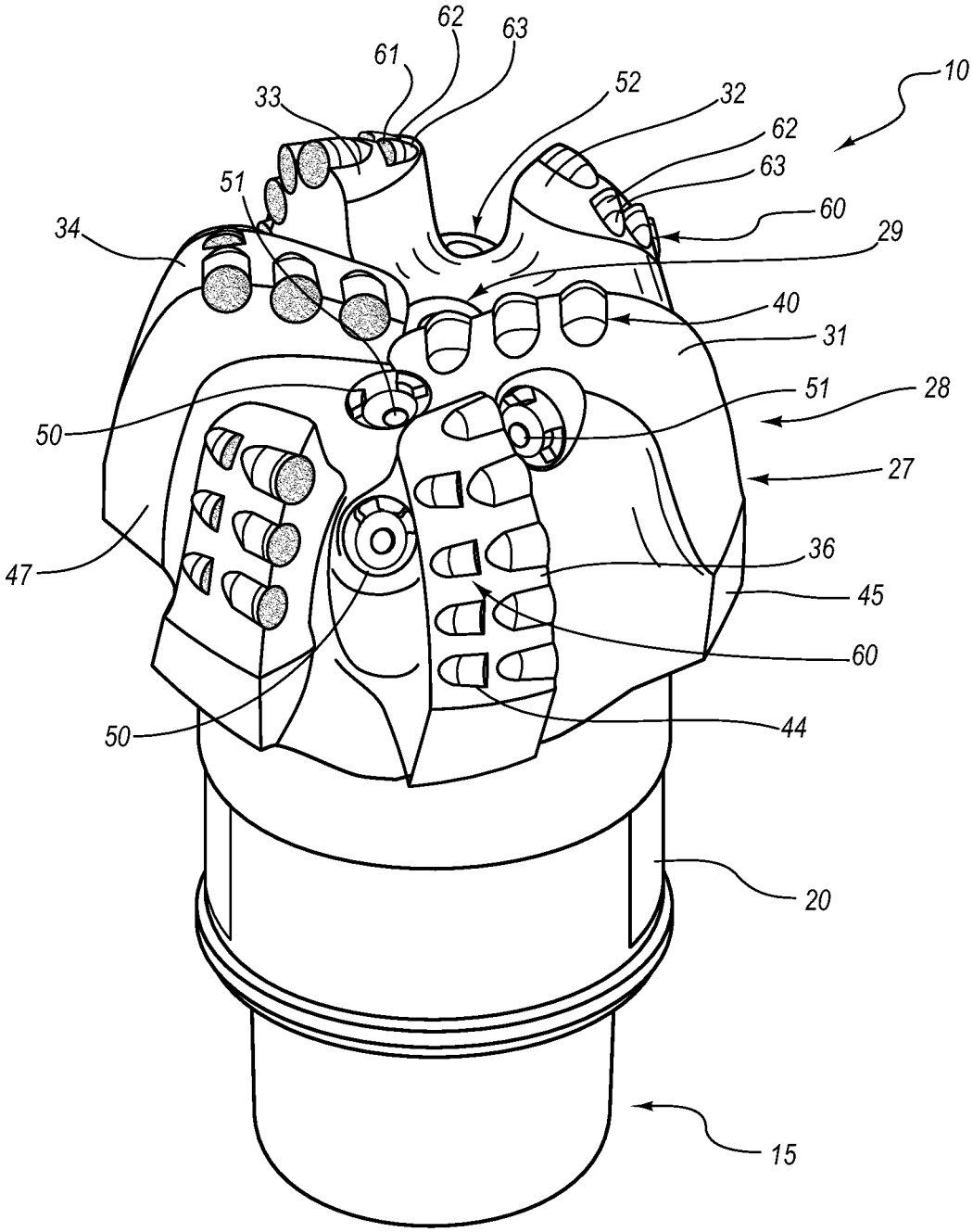
FIG. 10 is an isometric view another embodiment of a drill bit.
Figure 11:
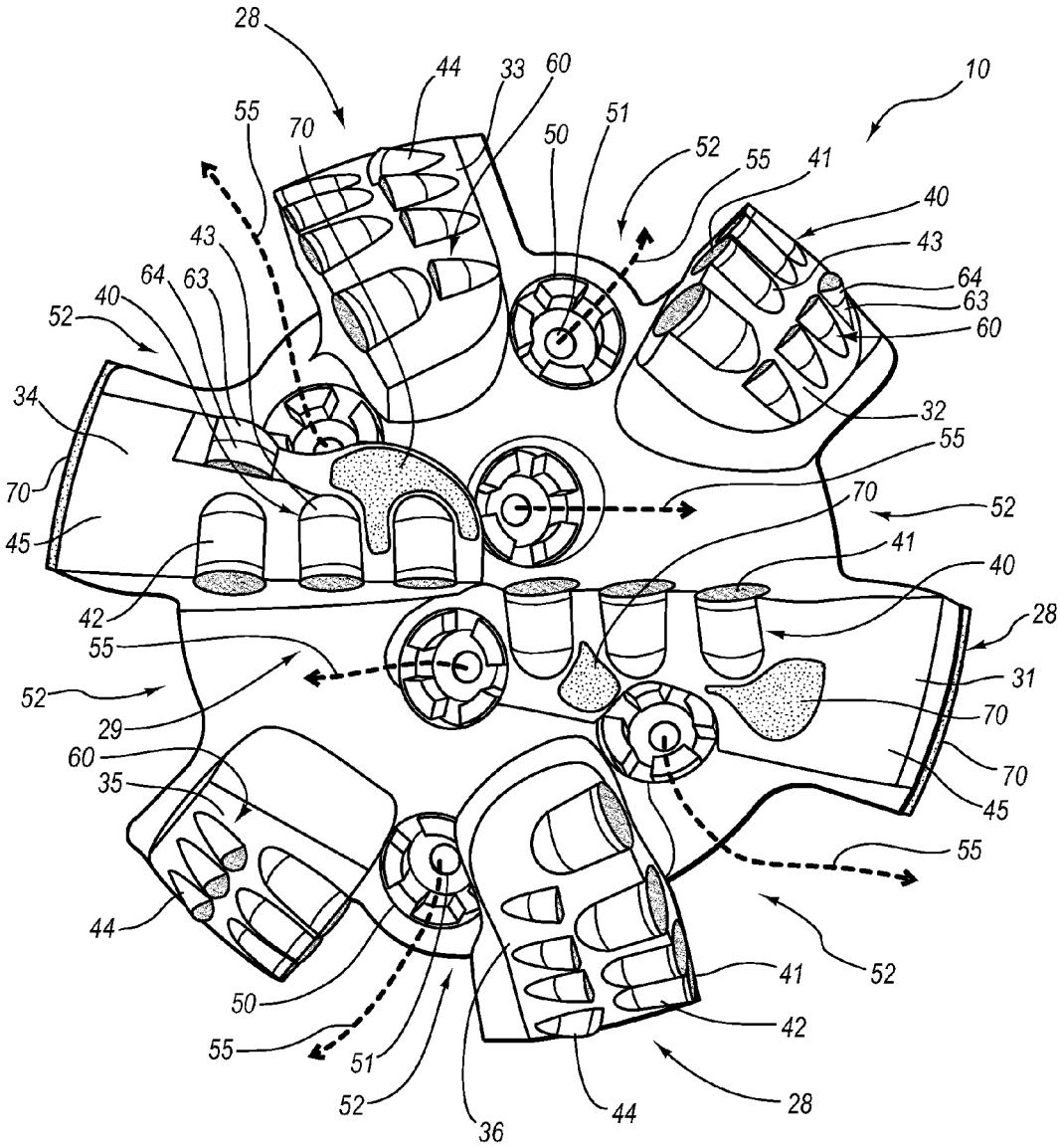
FIG. 11 is a top-view of another embodiment of the drill bit illustrated in FIG. 10.

Turning to FIGS. 10 and 11, optional elements included within the embodiment of drill bit 10 are illustrated. One or more backup cutters 60 are illustrated in FIG. 10 behind one or more cutters 40. While the backup cutter is illustrated behind a cutter 40 located primarily in the blade flank section 28 and blade shoulder section 27, backup cutters can be position in the cone section 29 of blade 34 and elsewhere. Thus, one or more backup cutters 60 can be positioned behind or in front of any selected cutters 40 on any selected blades 31-36 as illustrated in FIG. 10 and as discussed above and illustrated in FIG. 3.

The backup cutters 60 illustrated in FIG. 10 include a PDC cutting element 61, and substrate 62 positioned within a pocket 63 of the plurality of blades 31-36. The PDC backup cutters 60 are similar to the cutters 40 and may differ only in size and orientation as discussed above with respect to FIGS. 3-5 as compared to the associated cutter 40.

Illustrated in FIG. 11 are backup cutters 60 positioned into pockets 63 of the plurality of blades 31-36. In this embodiment, the backup cutters 60 are formed of tungsten carbide cutting elements 64 positioned behind or in front of any selected cutters 40 on any selected blades 31-36 as illustrated in FIG. 10 and as discussed above and illustrated in FIG. 3. Thus, what FIG. 11 illustrates is that the backup cutters 60 can be formed of PDC cutting elements, tungsten carbide, as well as synthetic and natural diamond, and other hard cutting elements.

Another optional element illustrated in FIG. 11 is hardfacing 70, typically applied through welding or brazing, to various locations of the drill bit 10. Hardfacing is an extra-hard or durable treatment to improve wear resistance and typically is applied to gauge pads 45, as discussed above, and, optionally, to the blades 31-36 in the cone section 29, around the cutters 40, and/or to the entire face of the drill bit 10.

Figure 12:
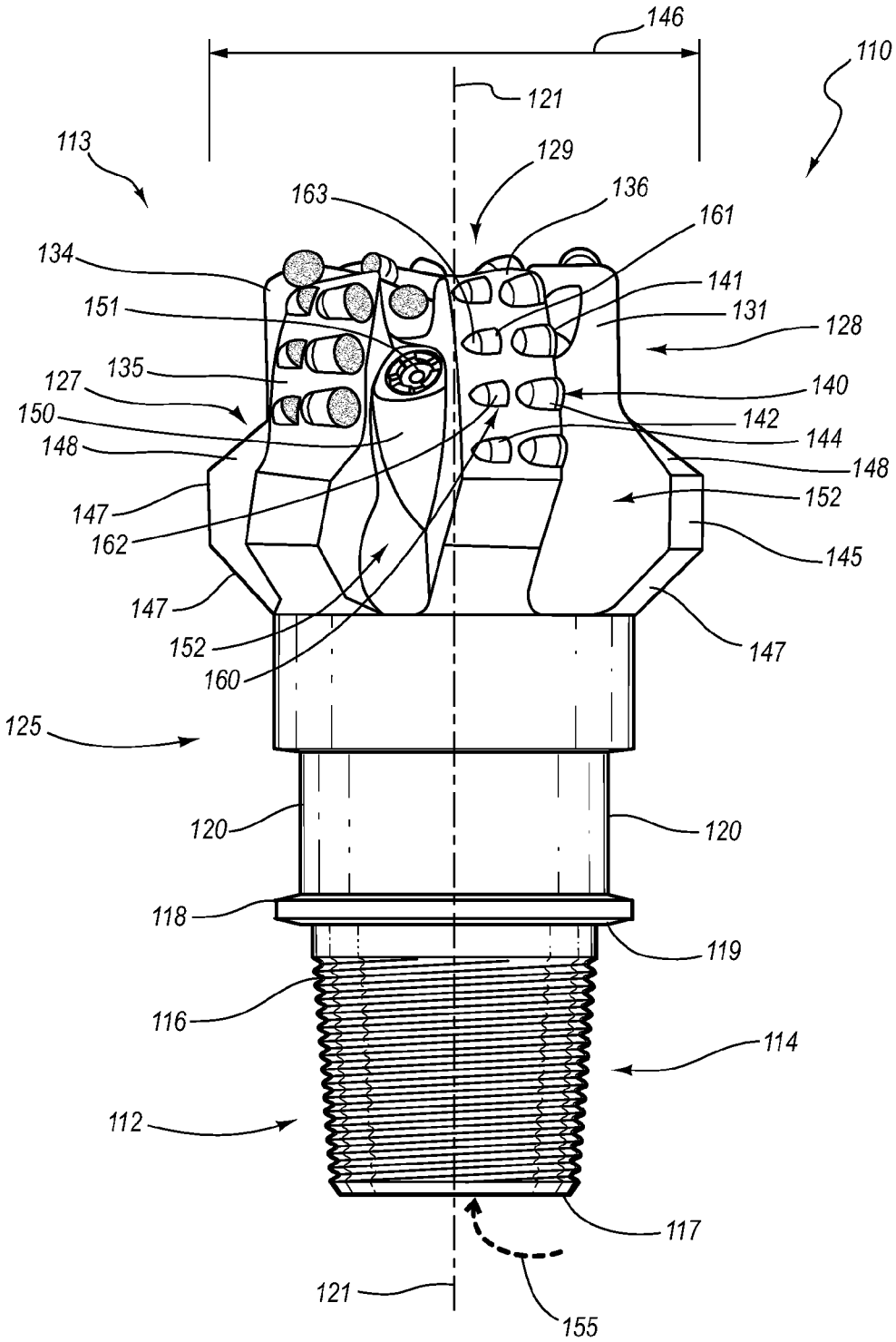
FIG. 12 is a side-view of another embodiment of a drill bit.
Figure 13:
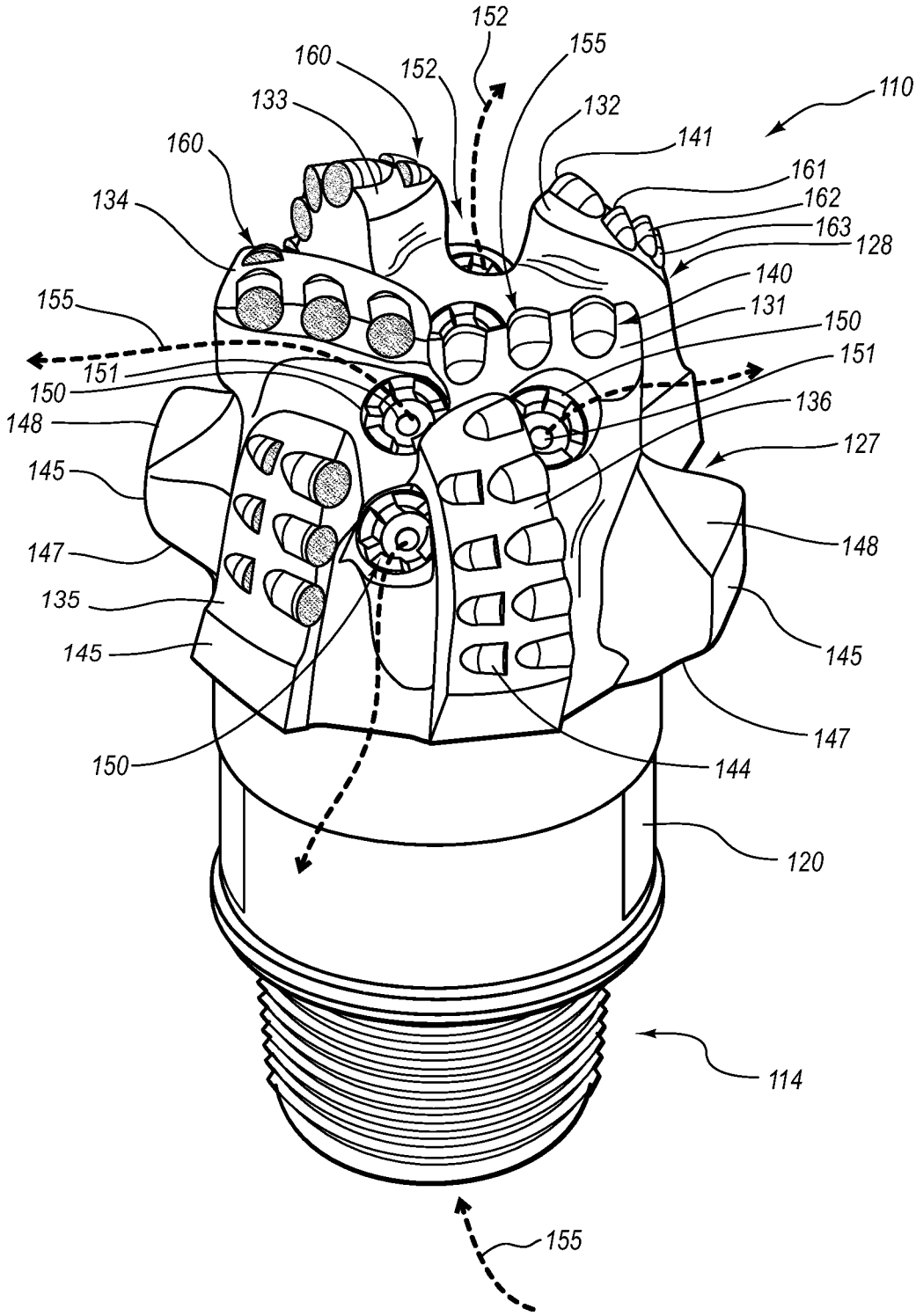
FIG. 13 is an isometric view of the embodiment of the drill bit illustrated in FIG. 12.
Figure 14:
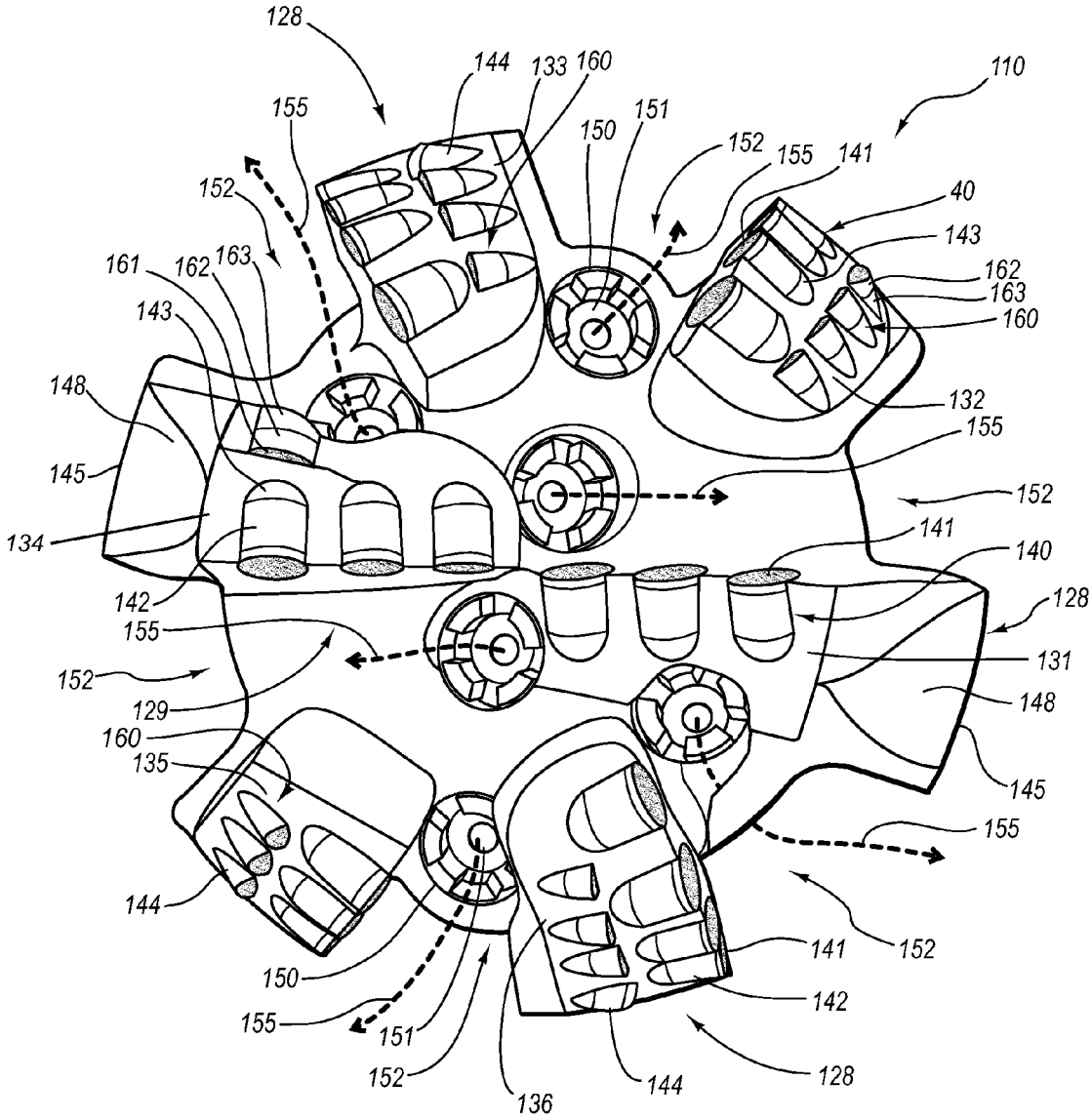
FIG. 14 is a top-view of the embodiment of the drill bit illustrated in FIG. 12.

Another embodiment of the invention is illustrated in FIGS. 12-14. The drill bit 110 includes a first end 112 having a pin connection 114 configured to couple the drill bit 110 to a drill string, as described above. Of course, box connections fall within the scope of the disclosures. The pin connection 114 includes a threads 116 that have a chamfer 117 configured to reduce stress concentrations at the end of the threads 116 and to ease mating with the box connection in the drill string, a shank shoulder 118, and the sealing face 119 of the connection. The threads typically are of a type described as an American Petroleum Institute (API) standard connection of various diameters as known in the art, although other standards and sizes fall within the scope of the disclosure. The threads 116 are configured to operably couple with the threads of a corresponding or analogue box connection in the drill string, collar, downhole motor, or other connection to the bit as known in the art. The sealing face 119 actually provides a mechanical seal between the drill bit 110 and the drill string and prevents any drilling fluid 155 passing through the inner diameter of the drill string and the drill bit 110 from leaking out.

The embodiments of the drill bit 110 optionally includes a breaker slot 120 configured to accept a bit breaker therein. The bit breaker is used to connect or mate the drill bit 110 to the drill string and provides a way to apply torque to the drill bit 110 (or to prevent the drill bit 110 from moving as torque is applied to the drill string) while the drill bit 110 and the drill string are being coupled together or taken apart.

The bit body 125 includes one or more drill bit blades connected thereto that extend past the bit body 125 in both a radial direction from the centerline 121 and a vertical direction towards and proximate to a second end 113 of the drill bit 110, as illustrated in FIG. 12, the bit body 125 being attached or fixedly coupled to the connection 114. The bit body 125 can be formed integrally with the drill bit blades, such as being milled out of a single steel blank. Alternatively, the drill bit blades 130 can be welded to the bit body. Another embodiment of the bit body 125 is one formed of a matrix sintered under temperature and pressure, typically a tungsten carbide matrix with a nickel binder, with drill bit blades 130 also integrally formed of the matrix with the bit body 125. A steel blank in the general shape of the bit body 125 and the drill blades can be used to form a scaffold and/or support structure for the matrix. The bit body 125 also can be formed integrally with the connection 114 from a steel blank or a steel connection 114 can be welded to the bit body 125.

The drill bit 110 includes one or more blades that includes a cone section 129 proximate the centerline 121 of the blades; a blade flank section 128 proximate the gauge, or maximum outer diameter 146 of the drill bit 110 and spaced laterally away (as represented in FIGS. 11-14 and discussed above with respect to FIG. 9) from the cone section 129; a blade shoulder section 127 spaced further laterally away from the flank section 128; and a gauge (or gage) pad 145 proximate the bit body 125, the gauge pad 145 optionally including a shoulder chamfer 148 on one or more of the blades; and a crown chamfer 147 adjacent to the bit body 125.

The drill bit 110 with blades 130 is illustrated to have 6 distinct blades 131, 132, 133, 134, 135, and 136 that are best illustrated in FIGS. 13 and 14. Each of the blades 131 through 136 is slightly different for the reasons that will be discussed below, including the shape of each blade and the placement of the cutters 140 along the blade. The blades can have a shape selected for various factors, including the formation drilled, the size of the hole desired, the capability of the equipment (drilling rig, drill string, etc.), cost, and other considerations.

A particular embodiment of the drill bit 110 includes two blades 131 and 134 that are quite different from the blades 31 and 34 discussed above and illustrated in FIGS. 1, 6, and 7. The blades 131 and 134 each have cutters 140 located substantially within the cone section 129, like the blades 31 and 34. Unlike blades 31 and 34, blades 131 and 134 have a substantial blade structure or portion only in the cone section 129 without any substantial blade structure in the blade flank section 128 and the blade shoulder section 127. In other words, the blades 131 and 134 truncate at a radial distance less than the maximum radial distance of the shoulder section 127 from the centerline 121, in this instance proximate the radial distance at which the blade flank section 128 begins. In some embodiments, the radial distance at which the blades 131 and 134 truncate overlaps with radial distance at which the blade flank section 128 begins. In yet other embodiments, the blades 131 and 134 truncate either at either shorter radial distances from the centerline 121 within the cone section 129 or at greater radial distances, such as in the blade flank section 128 and the blade shoulder section 127.

An advantage of the truncated blades 131 and 134 is that the respective fluid channels or junk slots 152 in this area are even larger, allowing for greater flow area for the drilling fluid 155 to pass in either direction, including reverse circulation. In addition, the larger fluid channels 152 are less susceptible to clogging by debris or formation cuttings.

A shoulder chamfer 148 extends from the bit body 25 towards the gauge pad 145 positioned in approximately the same plane as the respective blades 131 and 134 at a radial distance proximate the radial distance at which the blades 131 and 134 truncate. Shoulder chamfer 148 is illustrated as triangular in shape, although other shapes and configurations fall within the scope of the disclosure. The triangular shape in this instance is selected, in part, to promote the flow of drilling fluid 155 around the gauge pad 145 and to provide greater erosion resistance to the gauge pad 145. The gauge pads 145 associated with the blades 131 and 134 provide a point of contact with the well-bore along with the gauge pads 145 associated with the blades 132, 133, 135, and 136.

Drill bit 110 includes two blades 133 and 136 that have cutters located substantially in the blade flank section 128 and substantially in the blade shoulder section 127, and two blades 132 and 135 that have cutters located substantially in the flank section 128 and the shoulder section 127. Such a configuration with relatively larger diameter cutters 140 positioned in such a layout provides the higher rate-of-penetration as a four-bladed drill bit with the same size and number of cutters 140 positioned at the same radial distance from the centerline 121 of the drill bit 110, but provides the greater stability of a six-bladed drill bit. In addition, the dynamic response of the bit is improved with the shortened or truncated blades 131 and 134. Further, the fluid flow dynamics are improved because of the larger fluid flow channels 152 proximate the blades 131 and 134.

In other words, the novel configuration and placement of the cutters 140 around this embodiment and number of blades 131-136 provides improved performance as compared to previous versions of four and six-bladed drill bits. Of course, drill bits with different numbers of blades and cutters in which one or more shortened or truncated blades, or a first plurality of shortened or truncated blades, with one or more cutters positioned substantially in the cone section of the drill bit with an associated gauge pad, and a second plurality of blades with one or more cutters positioned substantially within the blade flank section and/or the blade shoulder section, fall within the scope of the embodiments disclosed herein.

The cutters 140 illustrated in the figures are of a polycrystalline diamond compact (PDC) type, but cutters of the other materials, such as tungsten carbide, natural or synthetic diamond, and other hard materials can be used as disclosed and discussed above. The embodiment of the cutters 140 include the PDC cutting element 141 configured with a side that interlocks with the substrate 142 and positioned in a pocket 143 of the blade 131, for example, as known in the art.

The drill bit 110 optionally includes a gauge pad 145 positioned a radial distance from the centerline 121 of one-half of the gauge diameter 146. The gauge pad 145 optionally includes gauge protection as discussed above, which can be hard-facing and/or a selected pattern of tungsten carbide, polycrystalline diamond, natural or synthetic diamond, and/or other hard material to provide increased wear-resistance to the gauge pad 145 to increase the probability that the drill bit 110 substantially retains its gauge diameter 146. The gauge pad 145 also optionally includes a crown chamfer 147 that forms the transition between the gauge pad 145 and the bit body 125.

Further, as the embodiment of drill bit 110 illustrated in FIGS. 12-14 indicates, there gauge pads 145 optionally are spaced in a vertical direction from its associated blade. For example, the gauge pad 145 associated with blades 131 and 134 have a vertical distance separating the blades 131, 134 from the triangular shoulder chamfer 148 as noted above. Thus, the gauge pads 145 may not form a discrete extension of the blades (as with the gauge pads 145 associated with the blades 132, 133, 135, and 136), but instead are separated from its associated blade.

Drill bit 110 optionally includes one or more gauge cutters 144 positioned in the blade shoulder section 127 to provide backup to the cutters at the greatest radial distance from the center of the drill bit 110. The backup cutter can be formed of tungsten carbide, PDC, synthetic or natural diamond, or other hard material.

Other features of the drill bit 110 include one or more nozzle bosses 150 that are an integral part of the bit body 125 and are configured to receive a jet nozzle 151 and including all the features and elements as described above with respect to drill bit 10.

The flow path of the drilling fluid 155 is best illustrated in FIG. 14. As illustrated, the various nozzle bosses 150 and jets or nozzles 151 have an orientation selected to enhance the removal of drill cuttings from cutters 140, the cone section 129, and the face of the bit and move them towards the annulus of the well-bore. Stated differently, the orientation of the nozzle boss 150 and the jets or nozzles 151 is such that the drilling fluid 155 cleans the cutters 140 and the blades 131-136 of the drill bit 110. While six nozzle bosses 150, one for each blade 131-136, exist, either more or less nozzle bosses can be used as selected for a given situation.

Optional elements included within the embodiment of drill bit 110 are illustrated in FIGS. 12-14. One or more backup cutters 160 are illustrated behind a plurality of cutters 140 located primarily in the blade flank section 128 and blade shoulder section 127, although one backup cutter 160 is present behind a cutter 140 located in the cone section 129 of blade 134. Thus, one or more backup cutters 160 can be positioned behind or in front of any selected cutters 140 on any selected blades 131-136 as illustrated in FIGS. 12-14 and as discussed above with respect to bit 10.

The backup cutters 160 illustrated include a PDC cutting element 161, and substrate 162 positioned within a pocket 163 of the plurality of blades 131-136, although other backup cutters disclosed and discussed above can be used.

Figure 15:
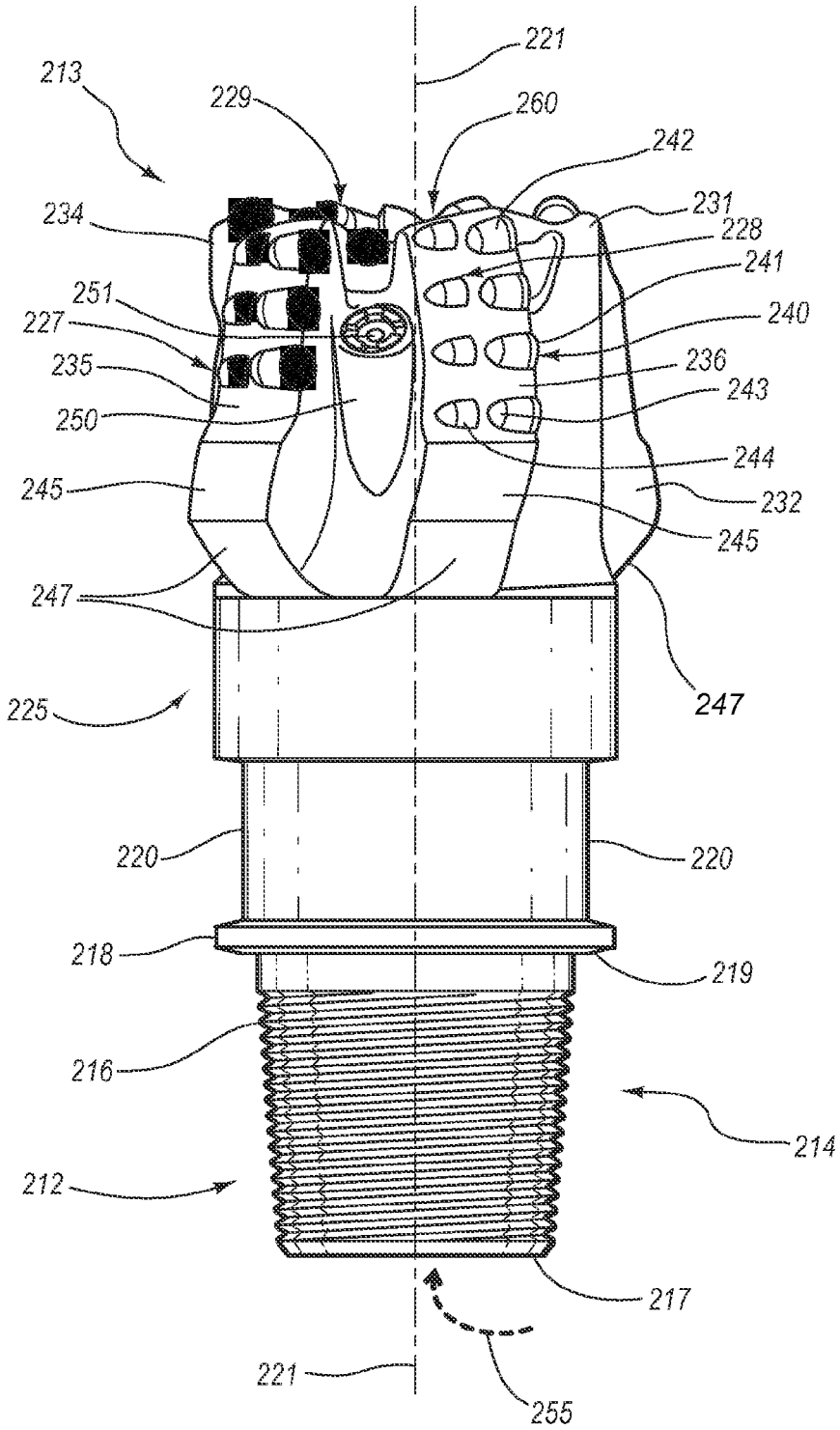
FIG. 15 is a side view of another embodiment of a drill bit.
Figure 16:
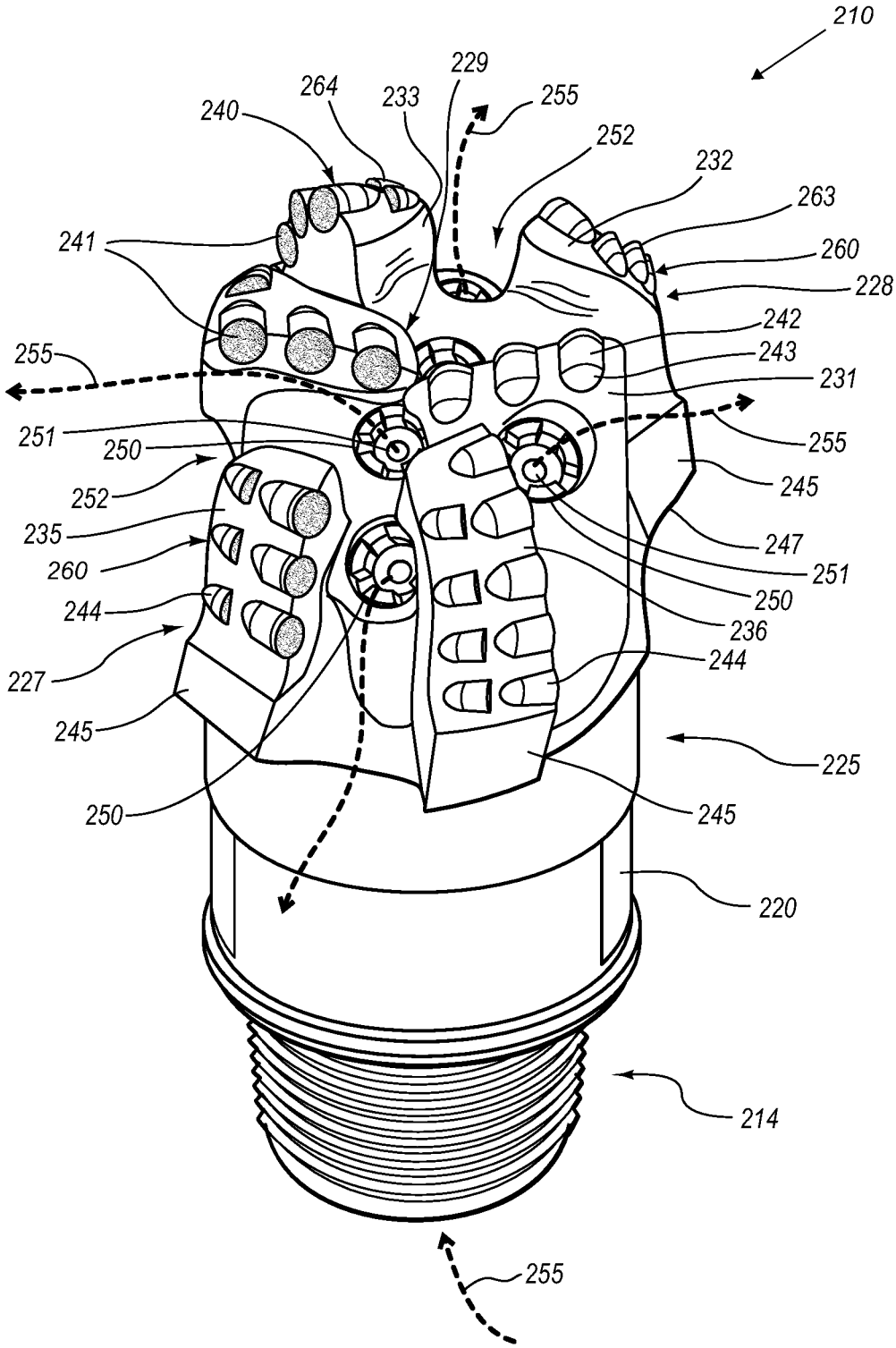
FIG. 16 is an isometric view of the embodiment illustrated in FIG. 15.
Figure 17:
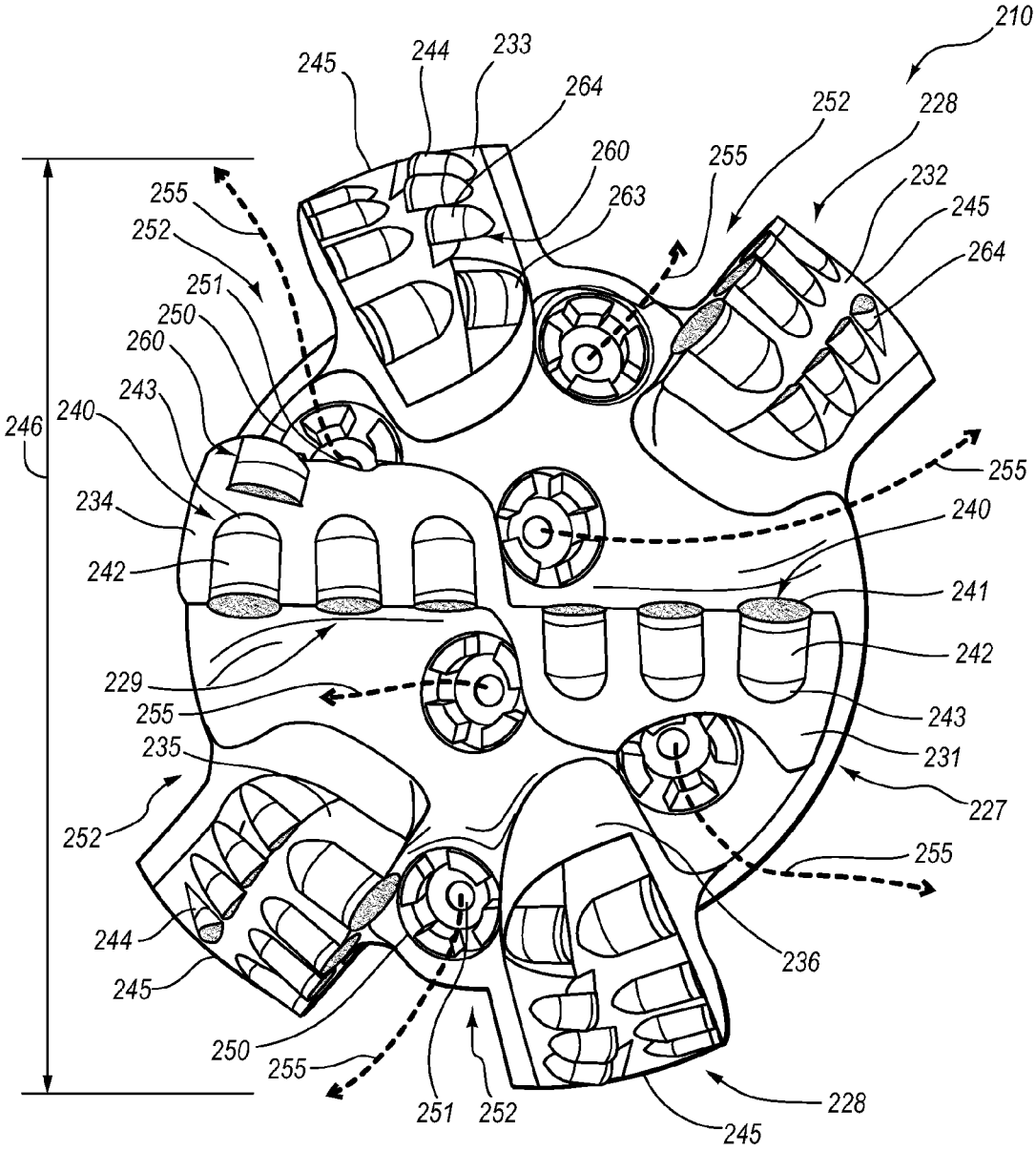
FIG. 17 is a top view of the embodiment of the drill bit illustrated in FIG. 1; and, FIG. 18 is a cross-section view of the drill bit illustrated in FIG. 1 showing the flow path of the drilling fluid.

Another embodiment of the invention is illustrated in FIGS. 15-17. The drill bit 210 includes a first end 212 having a pin connection 214 configured to couple the drill bit 210 to a drill string, as described above. Of course, box connections fall within the scope of the disclosures. The pin connection 214 includes a threads 216 that have a chamfer 217 configured to reduce stress concentrations at the end of the threads 216 and to ease mating with the box connection in the drill string, a shank shoulder 218, and the sealing face 219 of the connection.

The embodiments of the drill bit 210 optionally includes a breaker slot 220 configured to accept a bit breaker therein. The bit breaker is used to connect or mate the drill bit 210 to the drill string and provides a way to apply torque to the drill bit 210 (or to prevent the drill bit 210 from moving as torque is applied to the drill string) while the drill bit 210 and the drill string are being coupled together or taken apart.

The bit body 225 includes the drill bit blades connected thereto that extend past the bit body 225 in both a radial direction from the centerline 221 and a vertical direction towards and proximate to a second end 213 of the drill bit 210, as illustrated in FIG. 15, the bit body 225 being attached or fixedly coupled to the connection 214. The bit body 225 can be formed integrally with the drill bit blades, such as being milled out of a single steel blank. Alternatively, the drill bit blades can be welded to the bit body. Another embodiment of the bit body 225 is one formed of a matrix sintered under temperature and pressure, typically a tungsten carbide matrix with a nickel binder, with drill bit blades also integrally formed of the matrix with the bit body 225. A steel blank in the general shape of the bit body 225 and the drill blades can be used to form a scaffold and/or support structure for the matrix. The bit body 225 also can be formed integrally with the connection 214 from a steel blank or a steel connection 214 can be welded to the bit body 225.

The drill bit 210 includes one or more blades that includes a cone section 229 proximate the centerline 221 of the blades; a blade flank section 228 proximate the gauge, or maximum outer diameter 246 of the drill bit 210 and spaced laterally away (as represented in FIGS. 15-17 and discussed above with respect to FIG. 9) from the cone section 229; a blade shoulder section 227 spaced further laterally away from the flank section 228; and a gauge (or gage) pad 245 proximate the bit body 225, and a crown chamfer 247 adjacent to the bit body 225.

The drill bit 210 with blades is illustrated to have 6 distinct blades 231, 232, 233, 234, 235, and 236 that are best illustrated in FIGS. 16 and 17. Each of the blades 231 through 236 is slightly different for the reasons that will be discussed below, including the shape of each blade and the placement of the cutters 240 along the blade. The blades can have a shape selected for various factors, including the formation drilled, the size of the hole desired, the capability of the equipment (drilling rig, drill string, etc.), cost, and other considerations.

A particular embodiment of the drill bit 210 includes two blades 231 and 234 that are quite different from the blades 31 and 34 discussed above and illustrated in FIGS. 1, 6, and 7. The blades 231 and 234 each have cutters 240 located substantially within the cone section 229, like the blades 31 and 34. Unlike blades 31 and 34, blades 231 and 234 have a substantial blade structure or portion only in the cone section 229 without any substantial blade structure in the blade flank section 228 and the blade shoulder section 227. In other words, the blades 231 and 234 truncate at a radial distance proximate the radial distance at which the blade flank section 228 begins. In some embodiments, the radial distance at which the blades 231 and 234 truncate overlaps with radial distance at which the blade flank section 228 begins. In yet other embodiments, the blades 231 and 234 truncate at either shorter radial distances from the centerline 221 within the cone section 229 or at greater radial distances, such as in the blade flank section 228 and the blade shoulder section 227.

An advantage of the truncated blades 231 and 234 is that the respective fluid channels or junk slots 252 in this area are even larger, allowing for greater flow areas for the drilling fluid 255 to pass in either direction, including reverse circulation. In addition, the larger fluid channels 252 are less susceptible to clogging by debris or formation cuttings.

Blades 231 and 234 do not have a gauge pad 145 associated with the blades, in contrast to blades 31, 34, 131, and 134 discussed above. Instead, blades 231 and 234 transition into the blade body 225 at a radial distance from the centerline 221 proximate the greatest radial distance of the cone section 229.

Drill bit 210 includes two blades 233 and 236 that have cutters 240 located substantially in the blade flank section 228 and substantially in the blade shoulder section 227, and two blades 232 and 235 that have cutters 240 located substantially in the flank section 228 and the shoulder section 227. Each blade 232, 233, 235, and 236 has a gauge pad 245 associated therewith as illustrated in FIGS. 15-17. Such a configuration with relatively larger diameter cutters 240 positioned in such a layout provides the higher rate-of-penetration as a four-bladed drill bit with the same size and number of cutters 240 positioned at the same radial distance from the centerline 221 of the drill bit 210, but provides the greater stability of a six-bladed drill bit. For example, the asymmetric blade design improves the dynamic stability of the drill bit. In addition, the dynamic response of the bit is improved with the shortened or truncated blades 231 and 234 because less mass is located far from the centerline of the drill bit 210. That is, the mass of the blades 231 and 234 is located substantially in the cone section 229, whereas the mass of the blades 232, 233, 235, and 236 is located substantially in the blade shoulder section 227 and the blade flank section 228. Further, the fluid flow dynamics are improved because of the larger fluid flow channels 252 proximate the blades 231 and 234.

In other words, the novel configuration and placement of the cutters 240 around this configuration and number of blades 231-236 provides improved performance as compared to previous versions of four and six-bladed drill bits. Of course, drill bits with different numbers of blades and cutters in which one or more shortened or truncated blades, or a first plurality of shortened or truncated blades, with one or more cutters positioned substantially in the cone section of the drill bit, and a second plurality of blades with one or more cutters positioned substantially within the blade flank section and/or the blade shoulder section, fall within the scope of the embodiments disclosed herein.

The cutters 240 illustrated in the figures are of a polycrystalline diamond compact (PDC) type, but cutters of the other materials, such as tungsten carbide, natural or synthetic diamond, and other hard materials can be used as disclosed and discussed above. The embodiment of the cutters 240 include the PDC cutting element 241 configured with a side that interlocks with the substrate 242 and positioned in a pocket 243 of the blade 231, for example, as known in the art.

The drill bit 210 optionally includes a gauge pad 245 positioned a radial distance from the centerline 221 of one-half of the gauge diameter 246. The gauge pad 245 optionally includes gauge protection as discussed above, which can be hard-facing and/or a selected pattern of tungsten carbide, polycrystalline diamond, and/or natural diamond to provide increased wear-resistance to the gauge pad 245 to increase the probability that the drill bit 210 substantially retains its gauge diameter 246. The gauge pad 245 also optionally includes a crown chamfer 247 that forms the transition between the gauge pad 245 and the bit body 225.

As can be seen in the figure, the drill bit 210 includes four gauge pads 245 asymmetrically positioned around the drill bit 210. Such a configuration can improve bit stability in all applications, but particularly so when the drill bit is used with a bent sub or housing (i.e., a collar or connection that places the centerline of the drill bit at a small angle to the centerline of the drill string or downhole motor, typically on the order of 2.5° or less), such as on a downhole motor for directional drilling applications that may include 2-axis rotation (rotation around the centerline of the bent sub and rotation around the centerline of the downhole motor or drill string) and in oversize holes. Such an asymmetric configuration of gauge pads can be used in any of the embodiments disclosed herein.

Drill bit 210 optionally includes one or more gauge cutters 244 positioned in the blade shoulder section 227 to provide backup to the cutters at the greatest radial distance from the center of the drill bit 210. The backup cutter can be formed of tungsten carbide, PDC, synthetic or natural diamond, or other hard material.

Other features of the drill bit 210 include one or more nozzle bosses 250 that are an integral part of the bit body 225 and are configured to receive a jet or nozzle 251 and including all the features and elements as described above with respect to drill bit 10.

The flow path of the drilling fluid 255 is best illustrated in FIG. 17. As illustrated, the various nozzle bosses 250 and jets or nozzles 251 have an orientation selected to enhance the removal of drill cuttings from the cutters 240, the cone section 229, and the face of the bit and move them towards the annulus of the well-bore. Stated differently, the orientation of the nozzle boss 250 and jets or nozzles 251 is such that the drilling fluid 255 cleans the cutters 240 and the blades 231-236 of the drill bit 210. While six nozzle bosses 250, one for each blade 231-236, exist, either more or fewer nozzle bosses can be used as selected for a given situation.

Optional elements included within the embodiment of drill bit 210 are illustrated in FIGS. 15-17. One or more backup cutters 260 are illustrated behind a plurality of cutters 240 located primarily in the blade flank section 228 and blade shoulder section 227, although one backup cutter 260 is present behind a cutter 240 located in the cone section 229 of blade 234. Thus, one or more backup cutters 260 can be positioned behind or in front of any selected cutters 240 on any selected blades 231-236 as illustrated in FIGS. 15-17 and as discussed above.

The backup cutters 260 illustrated include a tungsten carbide cutting element 264 positioned within a pocket 263 of the plurality of blades 231-236, although other backup cutters disclosed and discussed above can be used.

Methods of building a drill bit that falls within the scope of the disclosure are also described. A bit body is formed with one or more drill bit blades connected thereto that extend past the bit body in both a radial direction from the centerline of the bit and a vertical direction towards and proximate to the second end 13 of the drill bit 10 as illustrated in FIG. 1. The bit body can be formed integrally with the drill bit blades, such as being milled out of a single steel blank. Alternatively, the drill bit blades can be welded to the bit body. Another embodiment of the bit body and blades is one formed of a matrix sintered in a mold of selected size and shape under temperature and pressure, typically a tungsten carbide matrix with a nickel binder, with drill bit blades also integrally formed of the matrix with the bit body. A steel blank in the general shape of the bit body and the drill blades can be used to form a scaffold and/or support structure for the matrix.

A selected number of blades are milled or molded to have a selected shape in consideration of various factors, including the geophysical properties of the formation to be drilled as described above. The blades may be symmetric or asymmetric relative to the drill bit body and to each other, as illustrated in the figures.

The bit body is attached, joined, or fixedly coupled to a connection, such as a pin connection described above, configured to connect the drill bit to a drill string, downhole motor, or other means of applying a rotary force or torque to the drill bit. The bit body also can be formed integrally with the connection from a steel blank or a steel connection can be welded to the bit body.

The inner annulus of the drill bit can be milled out of the connection. The nozzles, jets, ports, fluid channels and junk slots within the drill bit body, and one or more pockets in each of the drill bit blades configured to receive a cutter also can be milled out of the drill bit body. Alternatively, if the drill bit is formed from a matrix, special blanks may be placed within the mold at the location of the various features, such as the jets, nozzles, fluid channels, junk slots, and through holes with the matrix sintered about the blanks. Once the drill bit body is removed from its mold after the sintering process the blanks can be removed from the drill bit body, thereby revealing the desired hole or feature in the drill bit body. Any imperfections in the molding process can be removed through finish milling or other similar tool work.

Cutters configured to be received in the pockets in the drill bit blades are provided, the cutters including a means of securing the cutters within the through holes, such as by heat pressing or fitting, brazing, and other means known in the art. For example, the bit body may be heated to a temperature just below the melt temperature of the braze. The pocket into which a cutter is to be placed is locally heated to melt the braze and a preheated cutter is then placed in the pocket. The drill bit and cutter are allowed to cool, allowing the braze to solidify.

Optional features such as gauge or backup cutters are positioned in either pockets milled or molded to receive them. Hardfacing is optionally applied in various locations as described above, as is any selected gauge protection.

The one or more present inventions, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A drill bit for earth boring comprising:

a bit body having a first end and a second end spaced apart from said first end;

connection means connected to said bit body for coupling said bit body to a rotating means for providing rotational torque to said bit body;

a cone section proximate said second end that extends a first radial distance from a centerline of said drill bit;

a flank section that extends from proximate said first radial distance to a second radial distance from said centerline that is greater than said first radial distance;

a shoulder section that extends from proximate said second radial distance to a third radial distance greater than said second radial distance, said third radial distance proximate a gauge radial distance that defines a maximum radius of said drill bit; and, a first plurality of blades connected to said bit body and extending away from said bit body from said shoulder section to said cone section, said first plurality of blades having a first plurality of cutters positioned in said cone section and no cutters positioned outside of said cone section; and, a second plurality of blades connected to said bit body and extending away from said bit body, said second plurality of blades having a second plurality of cutters positioned in at least one of said flank section and said shoulder section and said second plurality of said blades having no cutters positioned within said cone section.

2. The drill bit of claim 1, wherein said second plurality of blades extend away from said bit body in at least one of said blade flank section and said blade shoulder section.

3. A drill bit for earth boring comprising:

a bit body having a first end and a second end spaced apart from said first end;

connection means connected to said bit body for coupling said bit body to a rotating means for providing rotational torque to said bit body;

a cone section proximate said second end that extends a first radial distance from a centerline of said drill bit;

a flank section that extends from proximate said first radial distance to a second radial distance from said centerline that is greater than said first radial distance;

a shoulder section that extends from proximate said second radial distance to a third radial distance greater than said second radial distance, said third radial distance proximate a gauge radial distance that defines a maximum radius of said drill bit; and a first plurality of blades connected to said bit body, said first plurality of blades extending away from said bit body from said cone section to said shoulder section, said first plurality of blades having a mass located in said cone section, each blade of said first plurality of blades configured to receive at least one cutter only in said cone section and not outside of said cone section; and, a second plurality of blades connected to said bit body, said second plurality of blades having a mass located substantially in at least one of said blade flank section and said blade shoulder section, each blade of said second plurality of blades configured to receive at least one cutter only in at least one of said flank section or said shoulder section and not in said cone section.

4. The drill bit of claim 3, wherein said second plurality of blades extend away from said bit body in only said blade flank section and said blade shoulder section.

5. A method of making a drill bit for earth boring, said method comprising:

forming a bit body having a first end and a second end spaced apart from said first end;

forming a plurality of blades connected to and extending away from said bit body at least at said second end, said plurality of blades including:

a cone section at said second end that extends a first radial distance from a centerline of said drill bit;

a flank section that extends from proximate said first radial distance to a second radial distance from said centerline that is greater than said first radial distance;

a shoulder section that extends from proximate said second radial distance to a third radial distance greater than said second radial distance, said third radial distance proximate a gauge radial distance that defines a maximum radius of said drill bit; and forming a plurality of pockets configured to each receive a cutter, each pocket positioned at a selected location of each of said blades, wherein a first plurality of said blades extends from the cone section to the shoulder section and includes said selected locations positioned only is said cone section and none outside said cone section, and wherein a second plurality of said blades includes said selected locations positioned only in at least one of said flank section and said shoulder section, and none in said cone section;

placing said cutters in said pockets; and, forming a connection means connected to said bit body for coupling said bit body to a rotation means for providing rotational torque to said bit body.

6. The method of claim 5, wherein said second plurality of blades are formed to extend away from said bit body in at least one of said blade flank section and said blade shoulder section.

* * * * *